US012250989B2

(12) United States Patent
Chang et al.

(10) Patent No.: US 12,250,989 B2
(45) Date of Patent: Mar. 18, 2025

(54) SOLE STRUCTURE FOR ARTICLE OF FOOTWEAR

(71) Applicant: NIKE, Inc., Beaverton, OR (US)

(72) Inventors: Leo S. Chang, Portland, OR (US); Jeremy L. Connell, Hillsboro, OR (US); Nick S. Frank, Portland, OR (US); Rachel M. Savage, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 425 days.

(21) Appl. No.: 17/534,119

(22) Filed: Nov. 23, 2021

(65) Prior Publication Data

US 2022/0160077 A1 May 26, 2022

Related U.S. Application Data

(60) Provisional application No. 63/117,957, filed on Nov. 24, 2020.

(51) Int. Cl.
*A43B 13/20* (2006.01)

(52) U.S. Cl.
CPC ..... *A43B 13/20* (2013.01)

(58) Field of Classification Search
CPC ..... A43B 13/20; A43B 13/12; A43B 13/125; A43B 13/127; A43B 13/143; A43B 13/145; A43B 13/146; A43B 13/148; A43B 13/16; A43B 13/186; A43B 13/187; A43B 13/188
See application file for complete search history.

(56) References Cited

U.S. PATENT DOCUMENTS 4,307,521 A * 12/1981 Inohara ..... A43B 13/223 36/31
4,364,189 A * 12/1982 Bates ..... A43B 13/12 36/31
4,642,911 A * 2/1987 Talarico ..... A43B 13/12 36/142
4,730,402 A * 3/1988 Norton ..... A43B 13/12 36/114

(Continued)

FOREIGN PATENT DOCUMENTS

WO WO-2021138255 A1 7/2021

OTHER PUBLICATIONS

Shore A Hardness Scale Cross References. APS Elastomers. URL= "https://www.apstpe.com/media/pdf/Shore-Hardness-Scales.pdf" (Year: 2018).*

(Continued)

*Primary Examiner* — Jameson D Collier
(74) *Attorney, Agent, or Firm* — Honigman LLP; Matthew H. Szalach; Joanthan P. O'Brien

(57) ABSTRACT

A sole structure for an article of footwear includes a midsole having a footbed extending from a first end to a second end disposed at an opposite end of the midsole than the first end, a first flange extending in a first direction from the first end of the footbed to a first distal end and a second flange extending in a second direction from the second end of the footbed to a second distal end, and an outsole disposed on an opposite side of the midsole than the footbed and extending from the first distal end through a mid-foot region, the outsole including a greater rigidity than the midsole.

7 Claims, 32 Drawing Sheets

(56) References Cited

U.S. PATENT DOCUMENTS 4,864,739 A * 9/1989 Maestri ..... A43B 17/00 36/31
5,025,573 A * 6/1991 Giese ..... A43B 13/148 36/31
5,079,856 A * 1/1992 Truelsen ..... A43B 21/26 36/28
5,713,141 A 2/1998 Mitchell et al.
5,787,610 A * 8/1998 Brooks ..... A43B 7/141 36/31
5,952,065 A 9/1999 Mitchell et al.
6,582,786 B1 * 6/2003 Bonk ..... A43B 1/0045 428/476.3
6,810,606 B1 * 11/2004 Ellis, III ..... A43B 5/00 36/103
6,854,198 B2 * 2/2005 Brooks ..... A43B 7/1435 36/31
7,762,008 B1 * 7/2010 Clark ..... A43B 3/00 36/44
10,212,988 B2 * 2/2019 Youngs ..... A43B 13/125
10,617,174 B1 * 4/2020 Hopkins ..... A43B 11/00
2003/0172548 A1 * 9/2003 Fuerst ..... A43B 13/026 36/28
2005/0081406 A1 * 4/2005 Hoffer ..... A43B 13/223 36/59 R
2005/0144811 A1 * 7/2005 Harb ..... A43B 5/0466 36/117.3
2005/0268492 A1 * 12/2005 Fuerst ..... B29D 35/142 36/77 R
2010/0251565 A1 10/2010 Litchfield et al.
2013/0081305 A1 * 4/2013 Byrne ..... A43B 13/181 36/31
2014/0075778 A1 3/2014 Bruce et al.
2015/0082668 A1 * 3/2015 Nonogawa ..... A43B 7/144 36/30 R
2016/0366975 A1 * 12/2016 Toschi ..... A43B 7/24
2018/0146744 A1 * 5/2018 Guest ..... A43B 13/148
2018/0255868 A1 * 9/2018 Cole ..... A43B 13/42
2018/0360164 A1 * 12/2018 Markison ..... A43B 23/07
2019/0116929 A1 * 4/2019 Kurcinka ..... A43B 17/006
2020/0022452 A1 * 1/2020 Hatano ..... A43B 13/181
2020/0093220 A1 * 3/2020 Oda ..... A43B 3/24
2023/0284739 A1 * 9/2023 Hillyer ..... A43B 13/188

OTHER PUBLICATIONS

Shore A V.S. Shore 00 V.S Asker C. Worldwide Foam. URL= "https://worldwidefoam.com/wp-content/uploads/2022/01/ Shore-Hardness-Scales-20220128.pdf" (Year: 2022).*

European Patent Office (ISA), International Search Report and Written Opinion for PCT App. No. PCT/US2021/060741, mailed May 6, 2022.

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/117,957, filed on Nov. 24, 2020. The disclosure of this prior application is considered part of the disclosure of this application and is hereby incorporated by reference in its entirety.

FIELD

The present disclosure relates generally to an article of footwear, and more particularly to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The outsole provides abrasion-resistance and traction with the ground surface and may be formed from rubber or other materials that impart durability and wear-resistance, as well as enhance traction with the ground surface.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
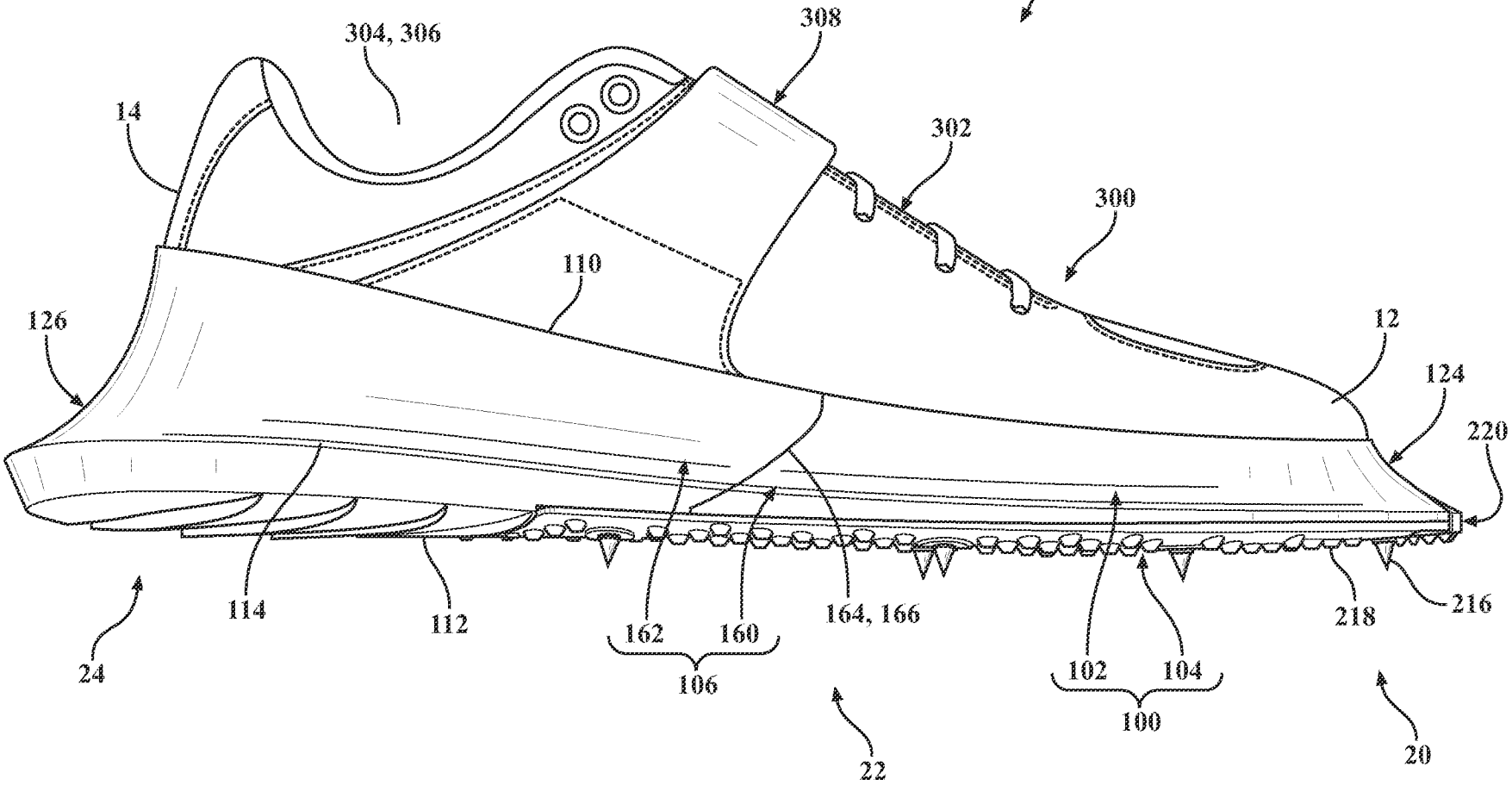
FIG. 1 is a lateral side elevation view of an article of footwear including an example of a sole structure according to principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a midsole having a footbed extending from a first end to a second end disposed at an opposite end of the midsole than the first end, a first flange extending in a first direction from the first end of the footbed to a first distal end and a second flange extending in a second direction from the second end of the footbed to a second distal end, and an outsole disposed on an opposite side of the midsole than the footbed and extending from the first distal end through a mid-foot region, the outsole including a greater rigidity than the midsole.

The sole structure may include one or more of the following optional features. For example, a thickness of the first flange may taper along a direction from the footbed to the first distal end. Additionally or alternatively, the first flange may include a concave upper surface and/or the second flange may include a concave upper surface.

In one configuration, the midsole may include an anterior cushioning member formed of a first material and a posterior cushioning member formed of a second material, the anterior cushioning member may include a greater hardness than the posterior cushioning member. The anterior cushioning member may include the first flange and the posterior cushioning member may include the second flange.

The first flange may extend from an anterior end of the sole structure and along a medial side of the sole structure and/or the second flange may extend from a posterior end of the sole structure and along a lateral side of the sole structure.

In one example, the midsole may include a bladder disposed in a forefoot region. A plate may be disposed adjacent to the bladder.

In another configuration, a sole structure for an article of footwear includes a cushioning element having a footbed extending from a first end to a second end disposed at an opposite end of the cushioning element than the first end, the cushioning element including a first flange projecting outwardly from the footbed at the first end and along a medial side and a second flange projecting outwardly from the footbed at the second end and along a lateral side. An outsole is disposed on an opposite side of the cushioning element than the footbed and extends from the first end through a mid-foot region, the outsole including a greater rigidity than the cushioning element.

The sole structure may include one or more of the following optional features. For example, a thickness of the first flange may taper along a direction from the footbed to a first distal end. Additionally or alternatively, the first flange may include a concave upper surface and/or the second flange may include a concave upper surface.

In one configuration, the cushioning element may include an anterior cushioning member formed of a first material and a posterior cushioning member formed of a second material, the anterior cushioning member may include a greater hardness than the posterior cushioning member. The anterior cushioning member may include the first flange and the posterior cushioning member may include the second flange. The anterior cushioning member may define a medial side of the cushioning element in a mid-foot region and/or the posterior cushioning member may define a lateral side of the cushioning element in the mid-foot region.

A bladder may be disposed in a forefoot region of the cushioning element. In this configuration, a plate may be disposed adjacent to the bladder.

In yet another configuration, a sole structure for an article of footwear includes a cushioning element having a first cushion disposed in a forefoot region of the sole structure and a second cushion disposed in a heel region of the sole structure, the second cushion being softer than the first cushion. An outsole extends over a portion of at least one of the first cushion and the second cushion and includes a greater rigidity than the first cushion and the second cushion.

The sole structure may include one or more of the following optional features. For example, the first cushion may overlap the second cushion in at least one of a forefoot region and a mid-foot region of the sole structure.

In one configuration, a first flange may project from an anterior end of the sole structure. In this configuration, the first flange may extend along a medial side of the sole structure. Additionally or alternatively, a second flange may project from a posterior end of the sole structure. The second flange may extend along a lateral side of the sole structure.

The sole structure may include a fluid-filled chamber. The fluid-filled chamber may be received within a cavity defined by the first cushion. The fluid-filled chamber may be pressurized.

In one configuration, the outsole may include at least one traction element. The at least one traction element may be formed from the same material as the outsole. Alternatively, the at least one traction element may be formed from a different material than the outsole.

An article of footwear may incorporate the sole structure.

The details of one or more implementations of the disclosure are set forth in the accompanying drawings and the description below. Other aspects, features, and advantages will be apparent from the description, the drawings, and the claims.

Figure 4:
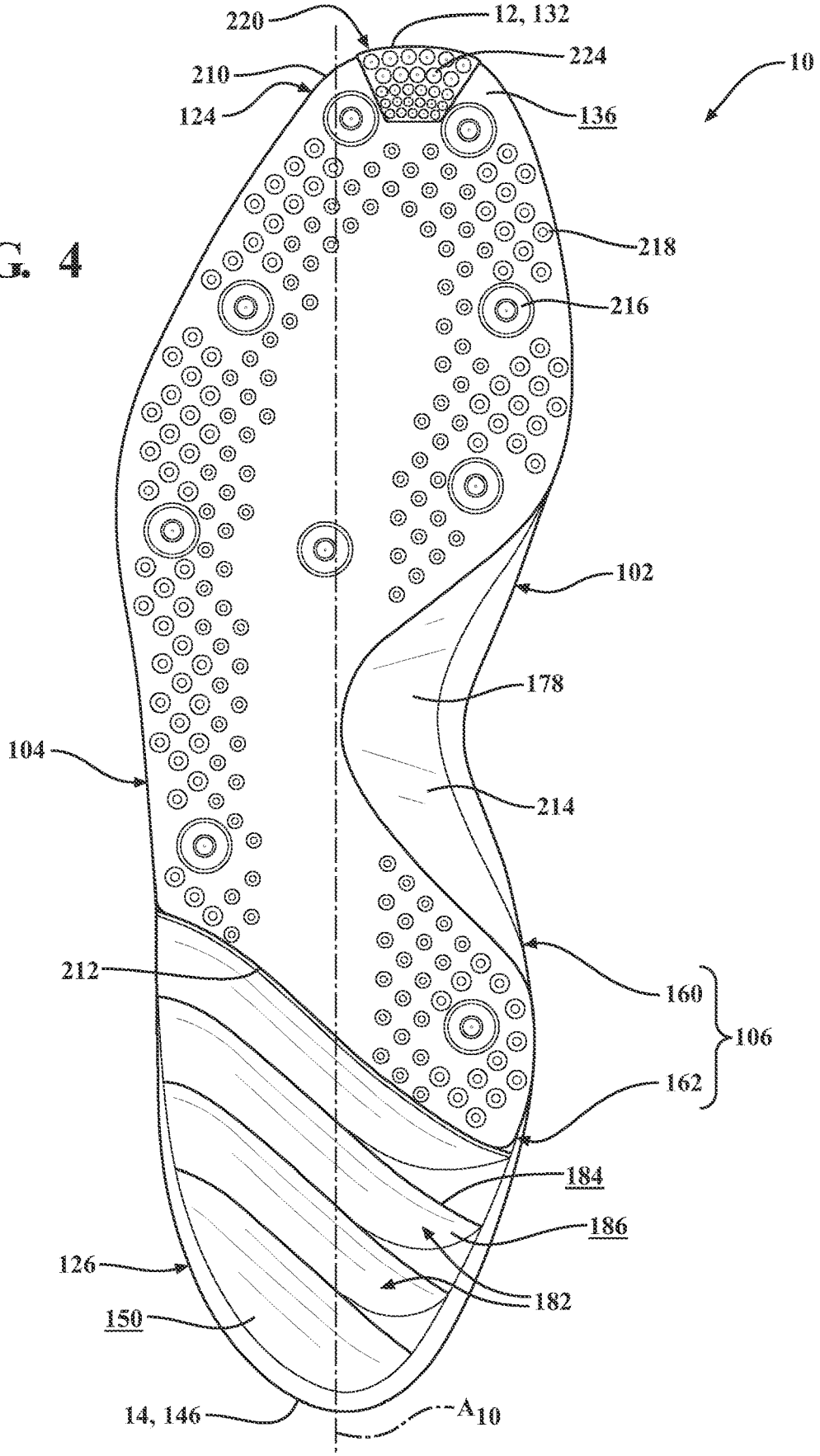
FIG. 4 is a bottom plan view of the sole structure of FIG. 1.

Referring to FIG. 1, an article of footwear 10 includes a sole structure 100 and an upper 300 attached to the sole structure 100. The footwear 10 may further include an anterior end 12 associated with a forward-most point of the footwear 10 and a posterior end 14 corresponding to a rearward-most point of the footwear 10. As shown in FIG. 4, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The mid-foot region 22 may correspond with an arch area of the foot, and the heel region 24 may correspond with rear portions of the foot, including a calcaneus bone.

The sole structure 100 includes a midsole 102 configured to provide cushioning and support and an outsole 104 defining a ground-engaging surface of the sole structure 100. Unlike conventional sole structures, which include monolithic midsoles and an outsole, the sole structure 100 of the present disclosure is configured as a composite structure including a plurality of components joined together. For example, the midsole 102 includes a resilient cushioning element 106 and a bladder 108.

As best shown in FIGS. 6-11, the midsole 102 includes a top side 110 facing the upper 300, a bottom side 112 formed on an opposite side of the midsole 102 than the top side 110 and facing away from the upper 300, and a peripheral side 114 extending between the top side 110 and the bottom side 112 and defining an outer periphery of the midsole 102. The top side 110 includes a foot cavity that defines a footbed 116 of the sole structure 100 extending continuously from a first end 118 at the anterior end 12 to a second end 120 at the posterior end 14. The bottom side 112 of the midsole 102 defines a profile of a ground-engaging surface of the sole structure 100 and may be at least partially covered by the outsole 104 when the sole structure 100 is assembled.

In the illustrated example, the cushioning element 106 and the bladder 108 cooperate to define the footbed 116 of the midsole 102. For example, the bladder 108 may define a portion of the footbed 116 in the forefoot region 20 while the cushioning element 106 forms a portion of the footbed 116 in the mid-foot region 22 and the heel region 24. Here, the cushioning element 106 defines a receptacle 122 extending through a thickness (i.e., from the top side 110 to the bottom side 112) of the cushioning element 106 such that a top surface of the bladder 108 is flush with a top surface of the cushioning element 106 on the top side 110 of the midsole 102 and a bottom surface of the bladder 108 is flush with a bottom surface of the cushioning element 106 on the bottom side 112 of the midsole 102.

In the illustrated example, the cushioning element 106 extends continuously from the anterior end 12 of the sole structure 100 to the posterior end 14 of the sole structure 100 and defines the peripheral side 114 of the midsole 102. As shown, the cushioning element 106 defines a pair of flanges 124, 126 disposed at opposite ends of the midsole 102. Particularly, the flanges 124, 126 include an anterior flange 124 extending outwardly from the first end 118 of the footbed 116 at the anterior end 12 of the sole structure 100 and a posterior flange 126 extending outwardly from the second end 120 of the footbed 116 at the posterior end 14 of the sole structure 100.

Figure 5:
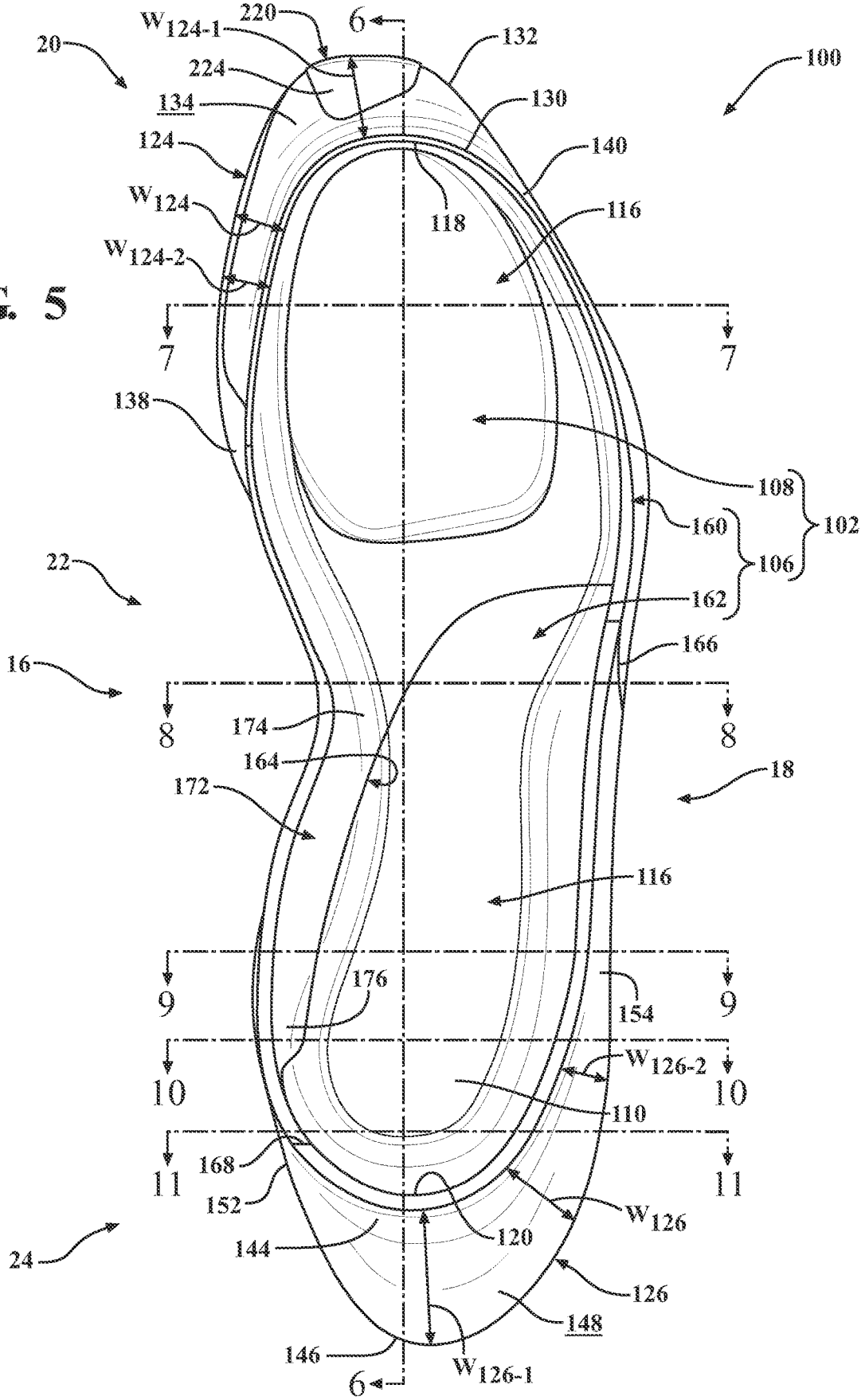
FIG. 5 is a top plan view of the sole structure of FIG. 1.

With reference to FIGS. 5-11, the anterior flange 124 has a width $W_{124}$ extending outwardly from a proximal end 130 attached to the footbed 116 to a distal end 132 facing away from the footbed 116. A thickness $T_{124}$ (FIG. 6) of the anterior flange 124 is defined by an upper surface 134 extending from the footbed 116 on the top side 110 and a lower surface 136 extending from the footbed 116 on the bottom side 112. As shown in FIG. 5, the anterior flange 124 wraps around the footbed 116 in the forefoot region 20—extending from a medial end 138 on the medial side 16 of the footbed 116 at the first end 118 to a lateral end 140 on the lateral side 18 of the footbed 116 adjacent to the mid-foot region 22. In other words, the anterior flange 124 extends around the anterior end 12 and along the medial side 16 in the forefoot region 20 and, to a lesser extent, along the lateral side 18 in the forefoot region 20.

As shown in FIGS. 1, 2, 6, and 7, the upper surface 134 and the lower surface 136 of the anterior flange 124 converge with each other along the direction from the proximal end 130 to the distal end 132 such that the thickness $T_{124}$ of the anterior flange 124 tapers to the distal end 132. In the illustrated example, the lower surface 136 of the anterior flange 124 is substantially continuous with the footbed 116 along the bottom side 112 of the midsole 102 and the upper surface 134 of the anterior flange 124 includes a concave curvature extending from the proximal end 130 to the distal end 132 to provide the anterior flange 124 with a variable taper along the width direction. Thus, the thickness $T_{124}$ decreases at a greater rate adjacent to the proximal end 130 than at the distal end 132. This progressive taper allows the distal end 132 of the anterior flange 124 to flex more easily, while providing the proximal end 130 of the anterior flange 124 with a greater stiffness.

Figure 3:
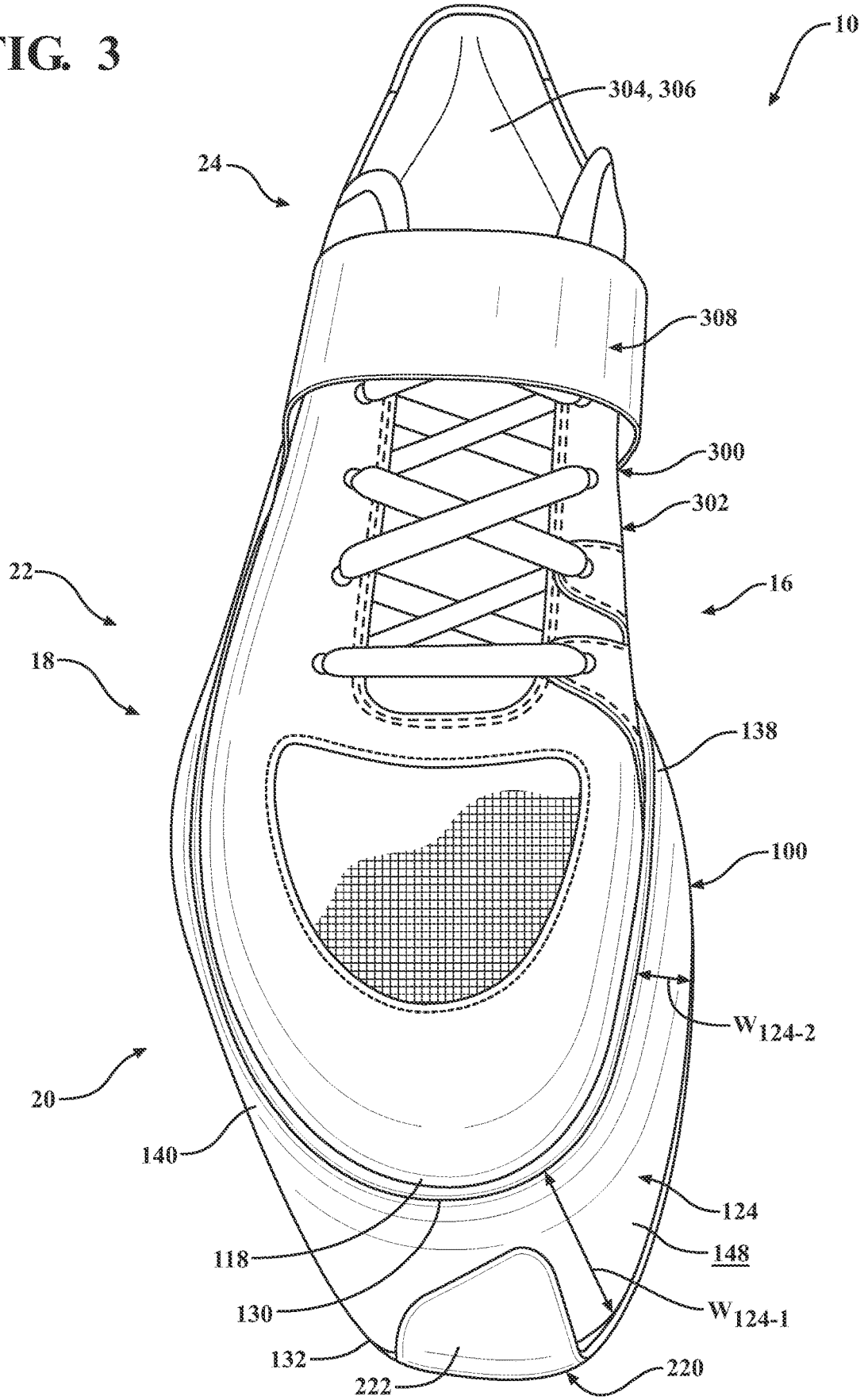
FIG. 3 is a top-front perspective view of the article of footwear of FIG. 1.

In addition to the tapering thickness $T_{124}$, the width $W_{124}$ of the anterior flange 124 may be variable along the path from the medial end 138 to the lateral end 140. For instance, with reference to FIG. 3, the anterior flange 124 may have a first width $W_{124\text{-}1}$ at the anterior end 12 of the sole structure 100. From the anterior end 12, the anterior flange 124 tapers to a second width $W_{124\text{-}2}$ along the medial side 16 of the forefoot region 20. The second width $W_{124\text{-}2}$ is less than the first width $W_{124\text{-}1}$ such that the anterior flange 124 projects a greater distance from the anterior end 12 than along the medial side 16.

Finally, and as best shown in FIG. 5, the portion of the flange 124 extending along the medial side 16 may be greater than the portion of the flange 124 extending along the lateral side 18. As such, the medial end 138 may be disposed closer to the heel region 24 than the lateral end 140 such that the length of the flange 124 along the medial side 16 is greater than the length of the flange 124 along the lateral side 18.

Referring to FIGS. 5 and 9-11, the posterior flange 126 has a width $W_{126}$ extending outwardly from a proximal end 144 attached to the footbed 116 to a distal end 146 facing away from the footbed 116. A thickness $T_{126}$ (FIG. 6) of the posterior flange 126 is defined by an upper surface 148 extending from the footbed 116 on the top side 110 and a lower surface 150 extending from the footbed 116 on the bottom side 112. As shown in FIG. 5, the posterior flange 126 wraps around the footbed 116 in the heel region 24—extending from a medial end 152 on the medial side 16 of the footbed 116 adjacent to the mid-foot region 22 to a lateral end 154 on the lateral side 18 of the footbed 116 at the second end 120. In other words, the posterior flange 126 extends around the posterior end 14 and along the lateral side 18 in the heel region 24 and, to a lesser extent, along the medial side 16 in the heel region 24.

As shown in FIGS. 1, 2, 6, and 7, the upper surface 148 and the lower surface 150 of the posterior flange 126 converge with each other along the direction from the proximal end 144 to the distal end 146 such that the thickness $T_{126}$ of the posterior flange 126 tapers to the distal end 146. In the illustrated example, the lower surface 150 of the posterior flange 126 is substantially continuous with the footbed 116 along the bottom side 112 of the midsole and the upper surface 148 of the posterior flange 126 includes a concave curvature extending from the proximal end 144 to the distal end 146 to provide the posterior flange 126 with a variable taper along the width direction. Thus, the thickness $T_{126}$ of the posterior flange 126 decreases at a greater rate adjacent to the proximal end 144 than at the distal end 146. This progressive taper allows the distal end 146 of the posterior flange 126 to flex more easily, while providing the proximal end 144 of the posterior flange 126 with a greater stiffness.

In addition to the tapering thickness $T_{126}$, the width $W_{126}$ of the posterior flange 126 may be variable along the path from the medial end 152 to the lateral end 154. For instance, with reference to FIG. 5, the posterior flange 126 may have a first width $W_{126\text{-}1}$ at the posterior end 14 of the sole structure 100. From the posterior end 14, the posterior flange 126 tapers to a second width $W_{126\text{-}2}$ along the medial side 16 of the heel region 24. The second width $W_{126\text{-}2}$ is less than the first width $W_{126\text{-}1}$ such that the posterior flange 126 projects a greater distance from the posterior end 14 than along the lateral side 18.

Finally, and as best shown in FIG. 5, the portion of the posterior flange 126 extending along the lateral side 18 may be greater than the portion of the posterior flange 126 extending along the medial side 16. As such, the lateral end 154 may be disposed closer to the forefoot region 20 than the medial end 152 such that the length of the posterior flange 126 along the lateral side 18 is greater than the length of the posterior flange 126 along the medial side 16.

While the cushioning element 106 may be formed as a monolithic structure including a homogenous elastomeric material, the cushioning element 106 of the present example may be defined in terms of a plurality of portions or subcomponents. For example, the cushioning element 106 includes an anterior cushioning member 160 disposed at the anterior end 12 and a posterior cushioning member 162 disposed adjacent the posterior end 14. The anterior cushioning member 160 and the posterior cushioning member 162 are joined to each other along a joint 164 extending across the width of the cushioning element 106. In the illustrated example, the joint 164 is configured as a scarf joint 164 extending across the cushioning element 106 from a first end 166 on the lateral side 18 in the mid-foot region 22 to a second end 168 on the medial side 16 in the heel region 24.

The anterior cushioning member 160 extends from a first end at the distal end 132 of the anterior flange 124 to a second end in the mid-foot region 22 defined by an anterior joint face 170 of the joint 164. As provided above, the joint 164 may be configured as a scarf joint 164. Here, the anterior joint face 170 is formed oriented at an oblique angle relative to the top and bottom sides 110, 112 of the cushioning element 106. In other words, the second end of the anterior cushioning member 160 tapers towards the bottom side 112 such that the bottom side 112 of the anterior cushioning member 160 extends beyond the top side 110 at the joint 164.

The anterior joint face 170 includes a first portion extending from the lateral end 166 of the joint 164 in a substantially lateral direction (i.e., at an obtuse angle relative to the longitudinal axis $A_{10}$) and a second portion extending from the first portion to the medial end 168 of the joint 164 in a substantially longitudinal direction (i.e., at an acute angle relative to the longitudinal axis). As shown, the second portion of the anterior joint face 170 is spaced apart from and extends substantially parallel to the peripheral side 114 to define an arm 172 extending along the medial side 16 of the cushioning element 106 in the heel region 24. The arm 172 extends from a proximal end 174 in the mid-foot region 22 to a distal end 176 in the heel region 24. As discussed below, the arm 172 and the posterior cushioning member 162 cooperate to form the cushioning element 106 in the heel region 24.

Figure 2:
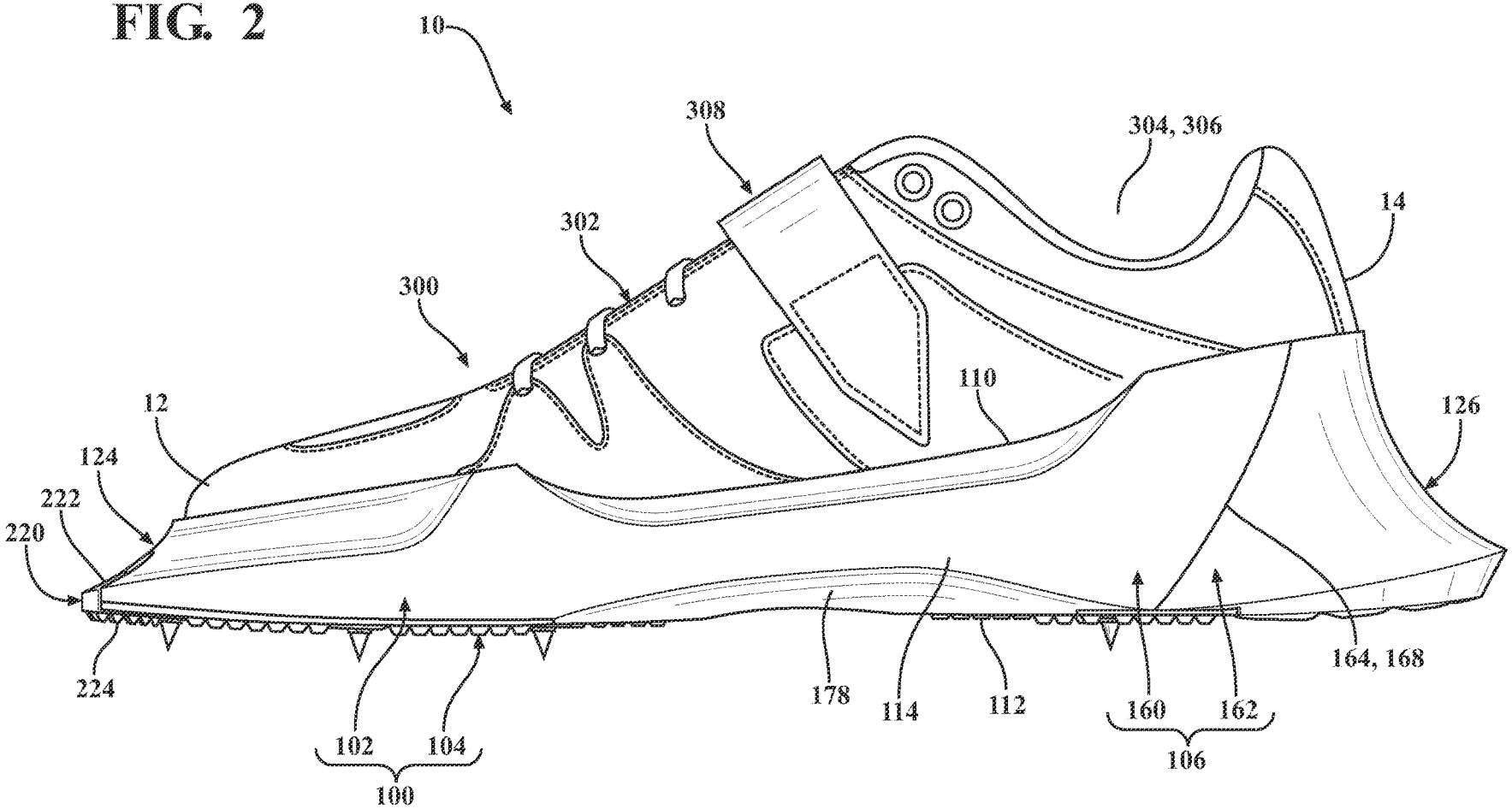
FIG. 2 is a medial side elevation view of the article of footwear of FIG. 1.
Figure 12:
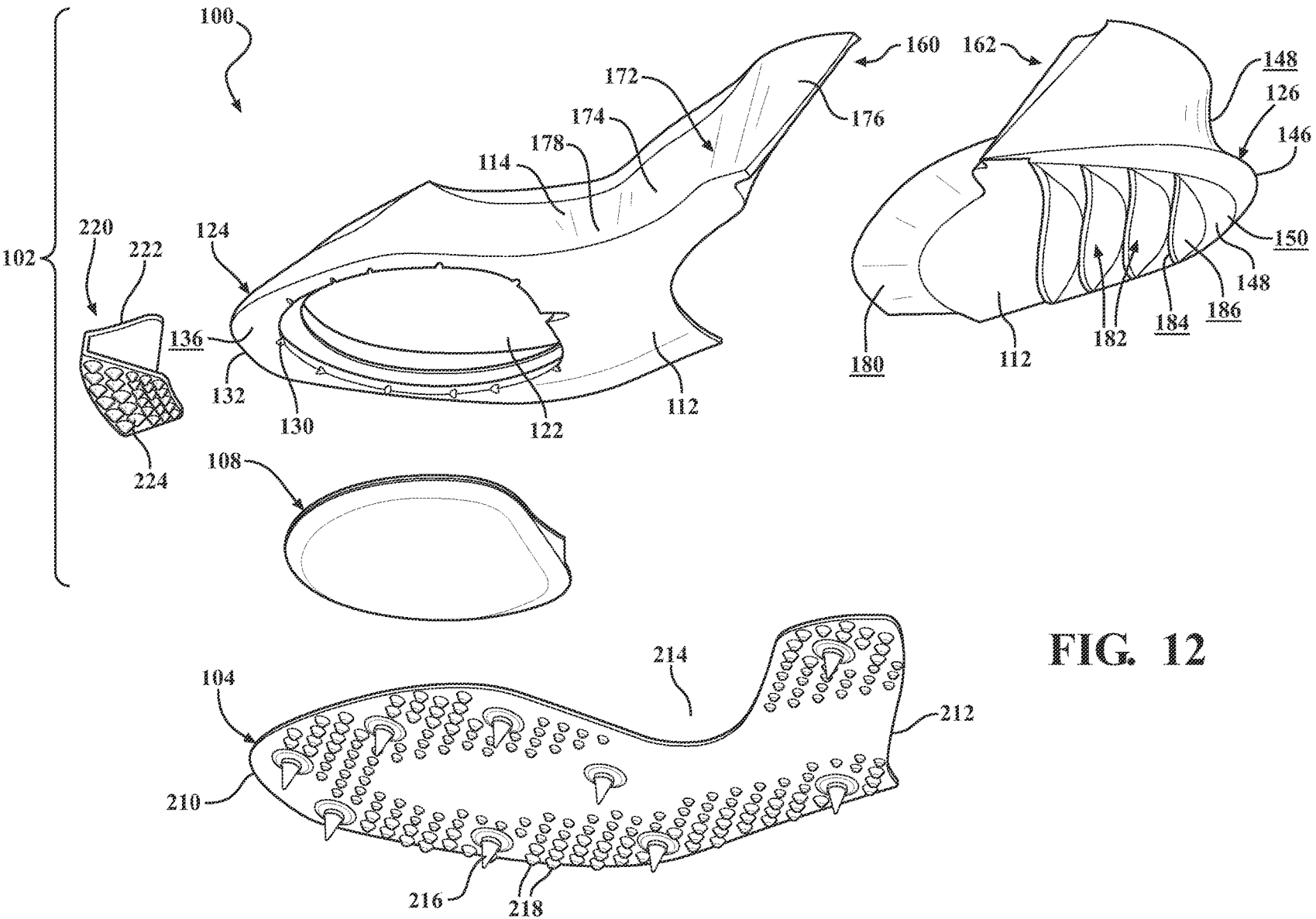
FIG. 12 is a bottom-rear exploded perspective view of the sole structure of FIG. 1.
Figure 13:
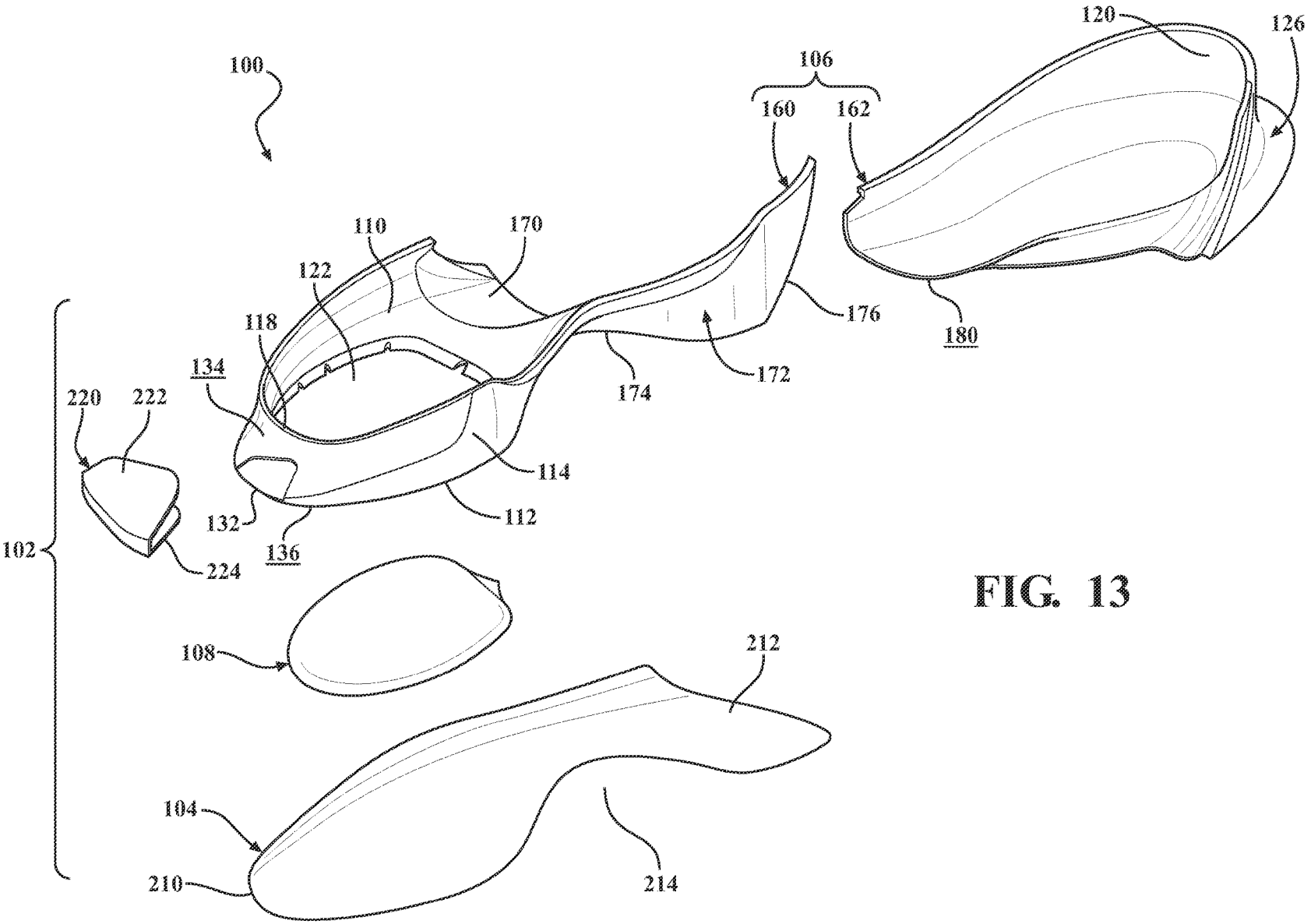
FIG. 13 is a top-front exploded perspective view of the sole structure of FIG. 1.
Figure 14:
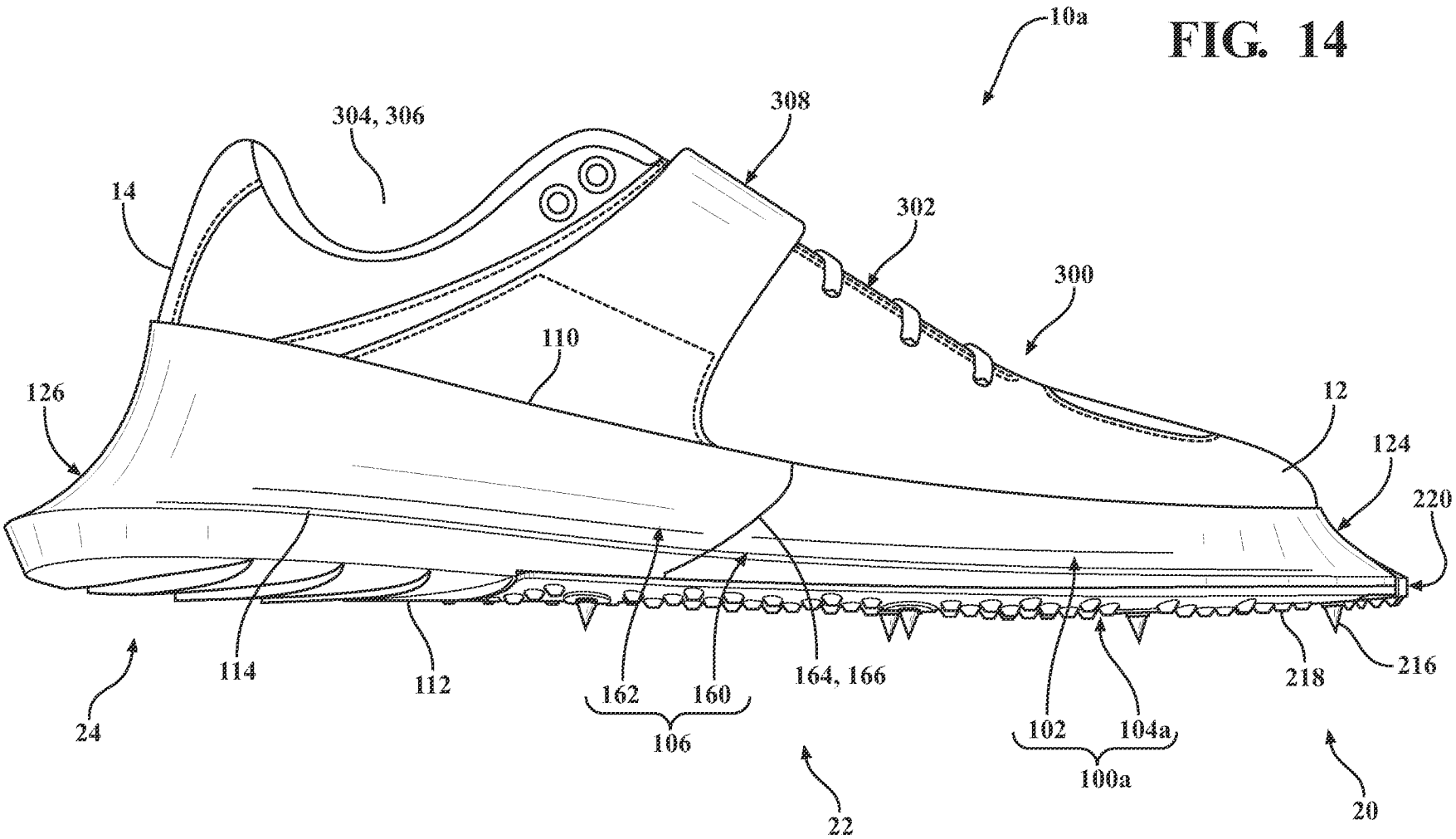
FIG. 14 is a lateral side elevation view of an article of footwear including another example of a sole structure according to principles of the present disclosure.
Figure 15:
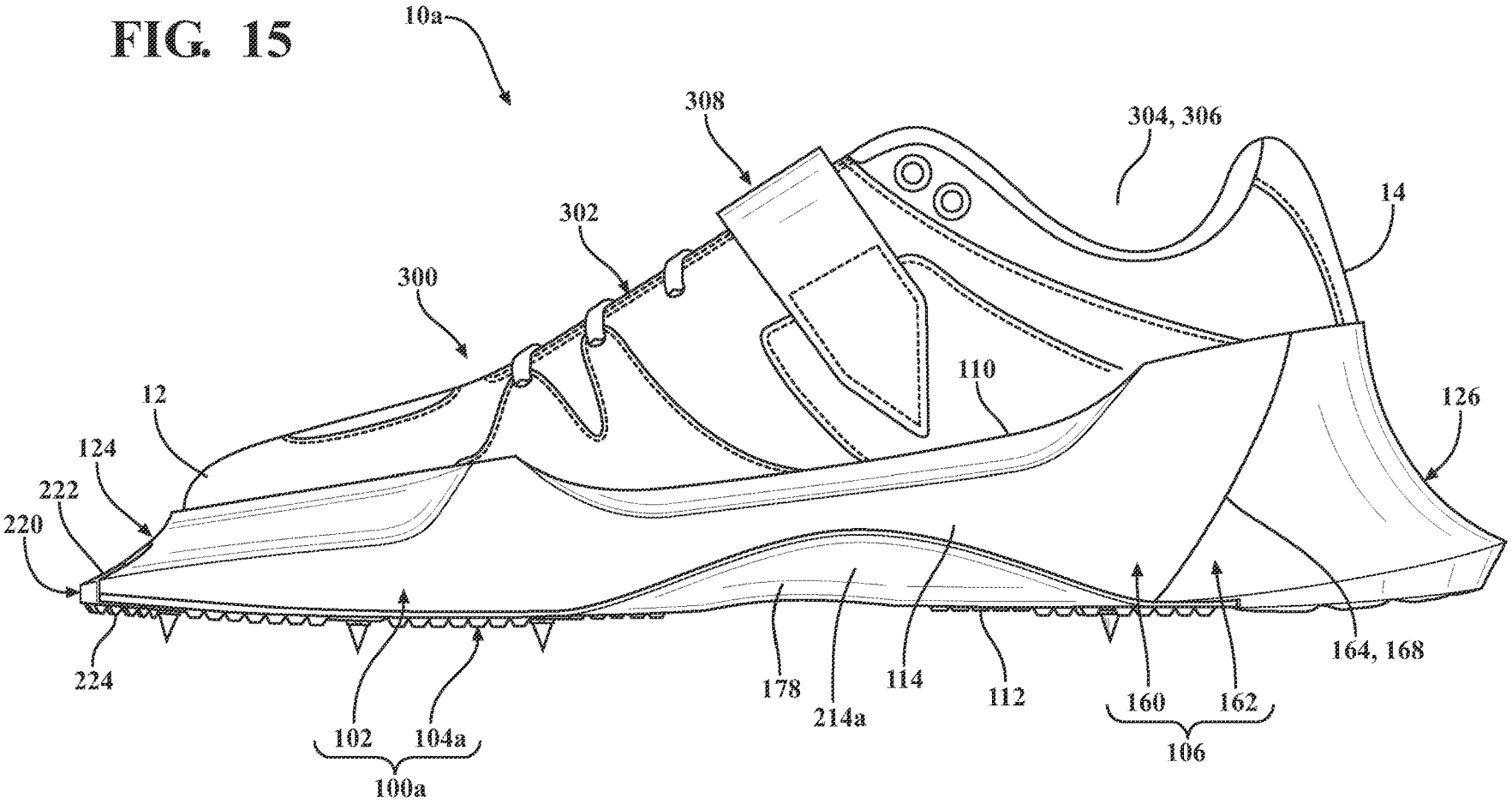
FIG. 15 is a medial side elevation view of the article of footwear of FIG. 14.
Figure 16:
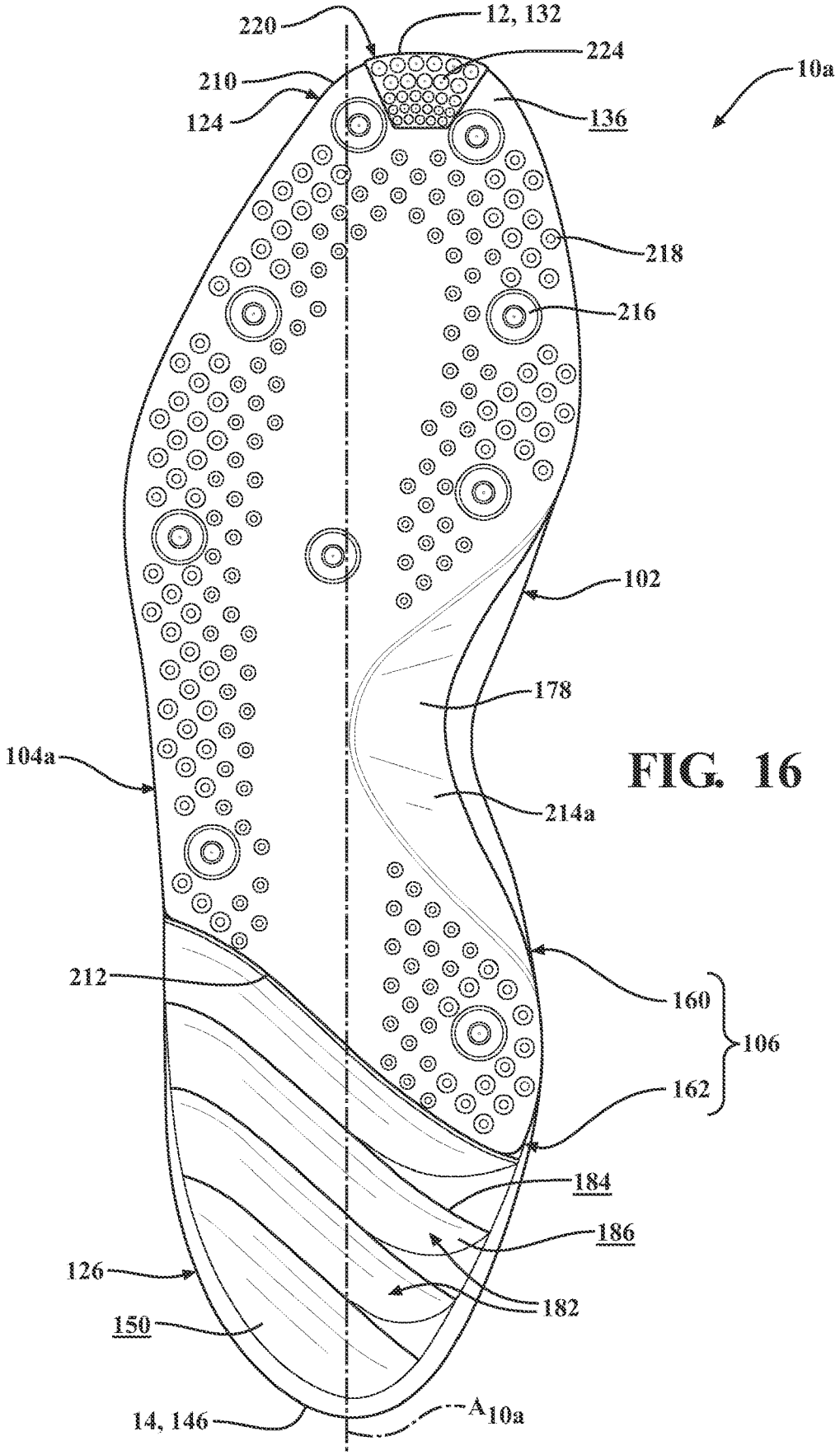
FIG. 16 is a bottom plan view of the sole structure of FIG. 14.
Figure 17:
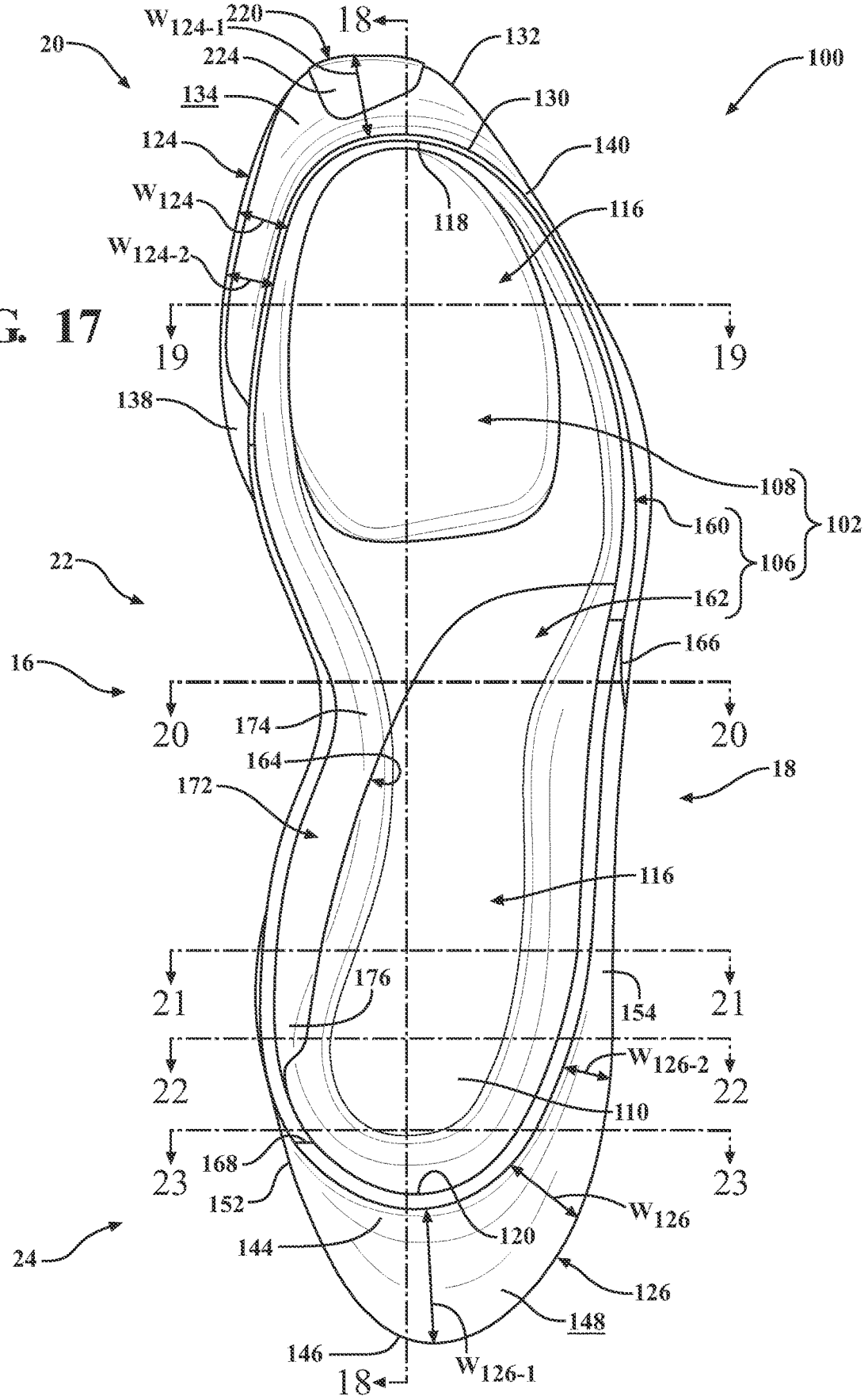
FIG. 17 is a top plan view of the sole structure of FIG. 14.
Figure 18:
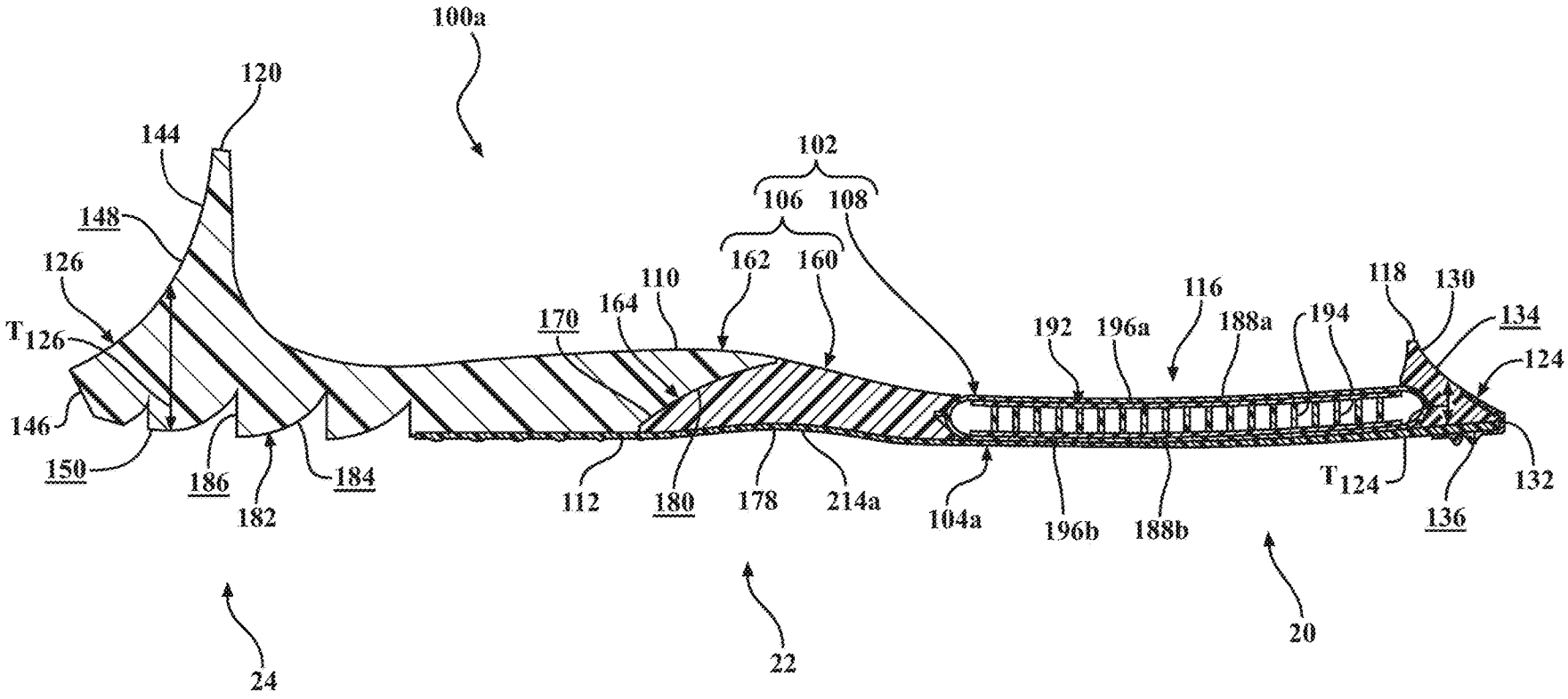
FIG. 18 is a cross-sectional view of the sole structure of FIG. 14, taken along Line 18-18 in FIG. 17.
Figure 19:
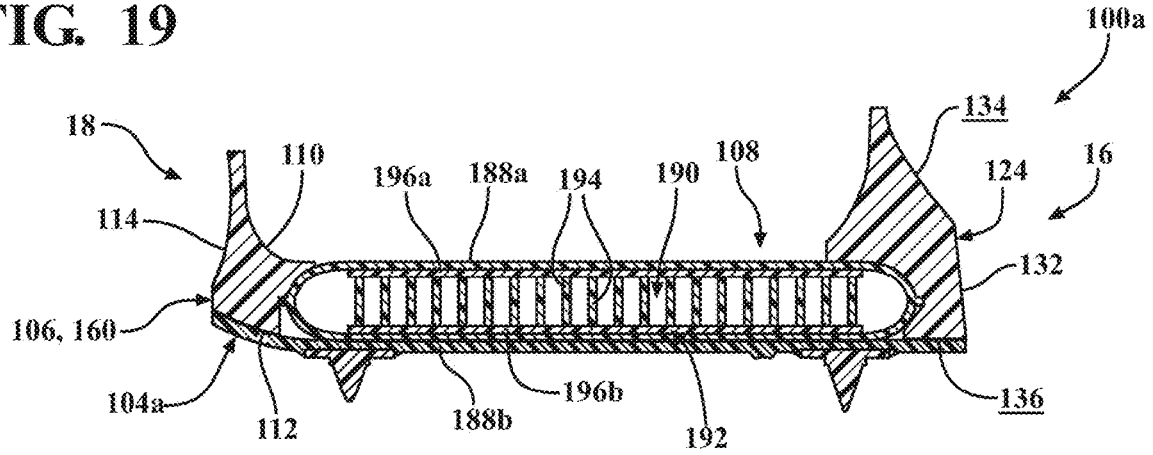
FIG. 19 is a cross-sectional view of the sole structure of FIG. 14, taken along Line 19-19 in FIG. 17.
Figure 20:
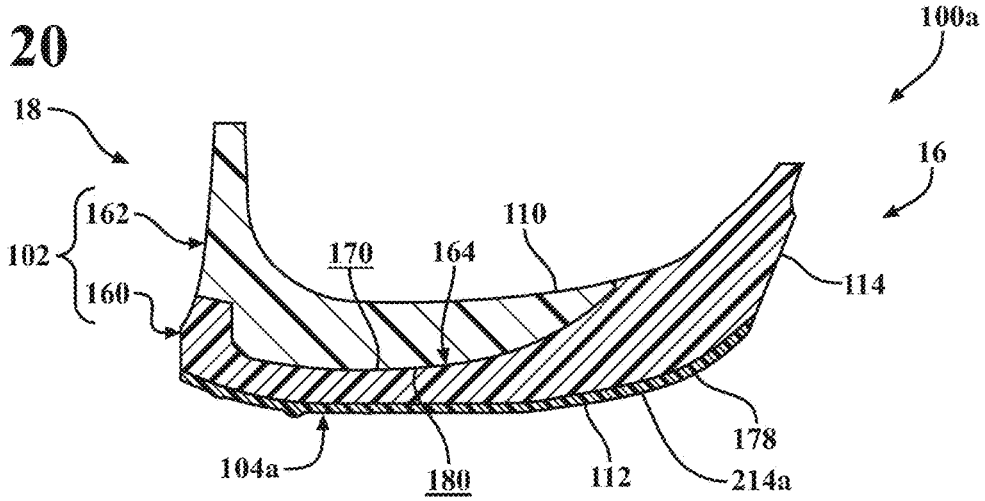
FIG. 20 is a cross-sectional view of the sole structure of FIG. 14, taken along Line 20-20 in FIG. 17.
Figure 21:
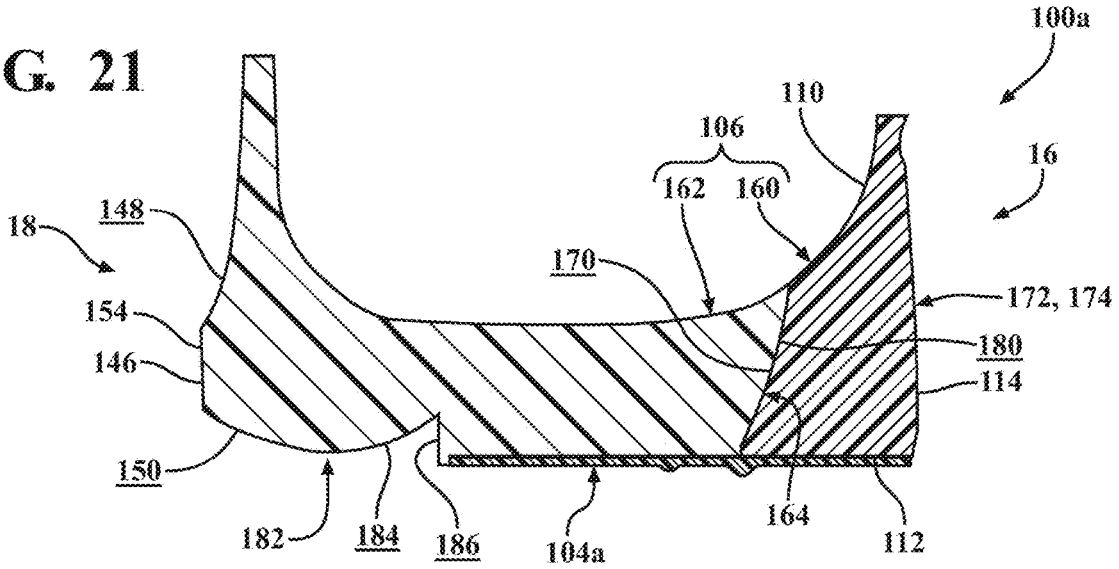
FIG. 21 is a cross-sectional view of the sole structure of FIG. 14, taken along Line 21-21 in FIG. 17.
Figure 22:
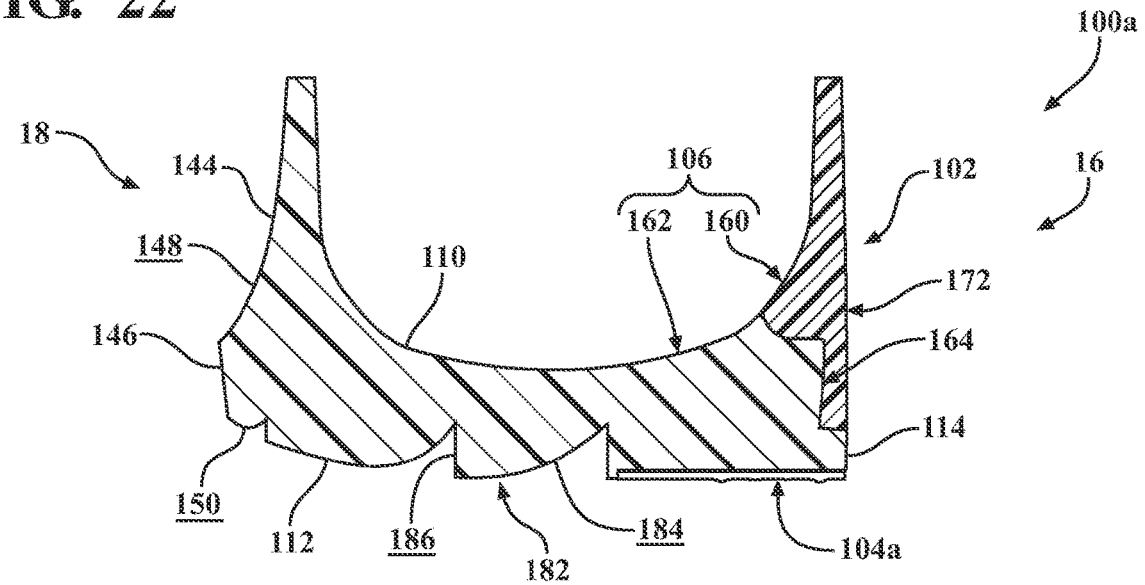
FIG. 22 is a cross-sectional view of the sole structure of FIG. 14, taken along Line 22-22 in FIG. 17.
Figure 23:
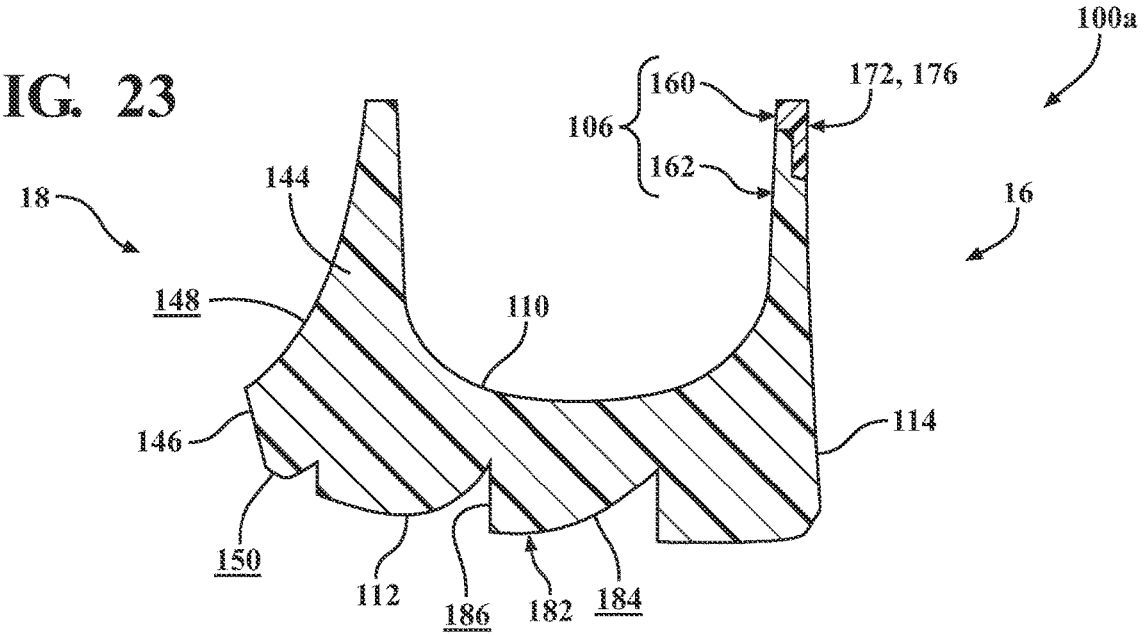
FIG. 23 is a cross-sectional view of the sole structure of FIG. 14, taken along Line 23-23 in FIG. 17.
Figure 24:
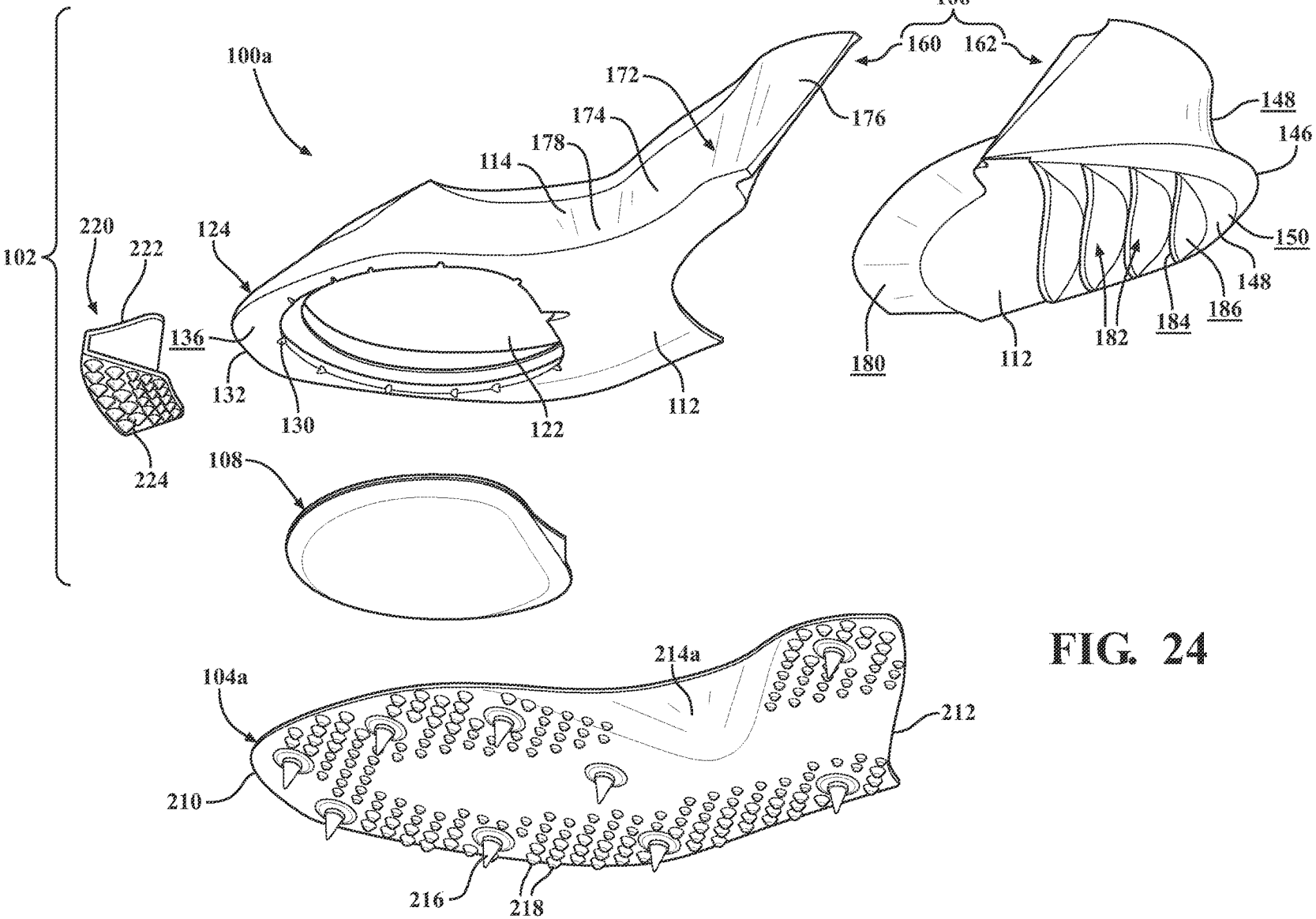
FIG. 24 is a bottom-rear exploded perspective view of the sole structure of FIG. 14.
Figure 25:
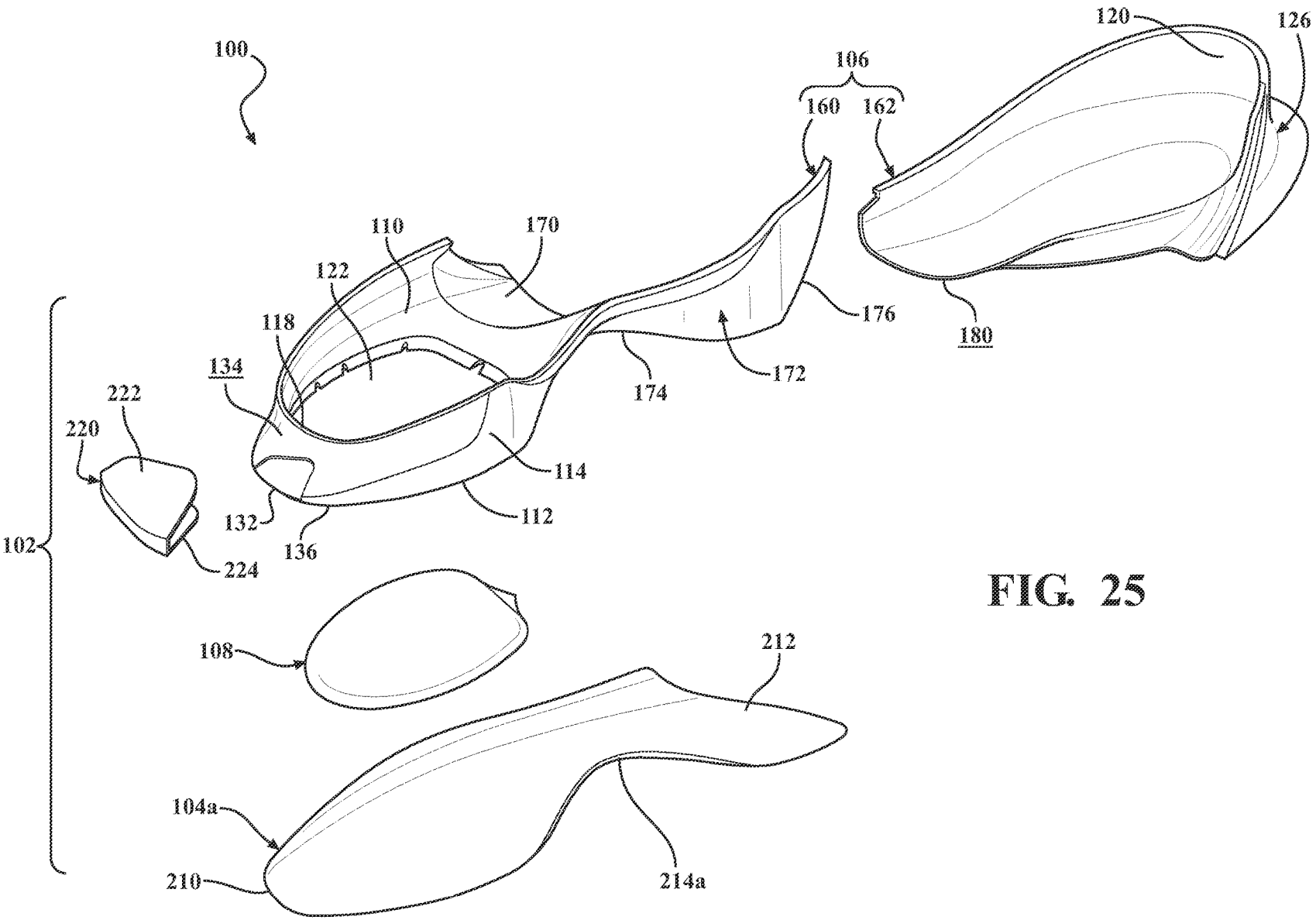
FIG. 25 is a top-front exploded perspective view of the sole structure of FIG. 14.
Figure 26:
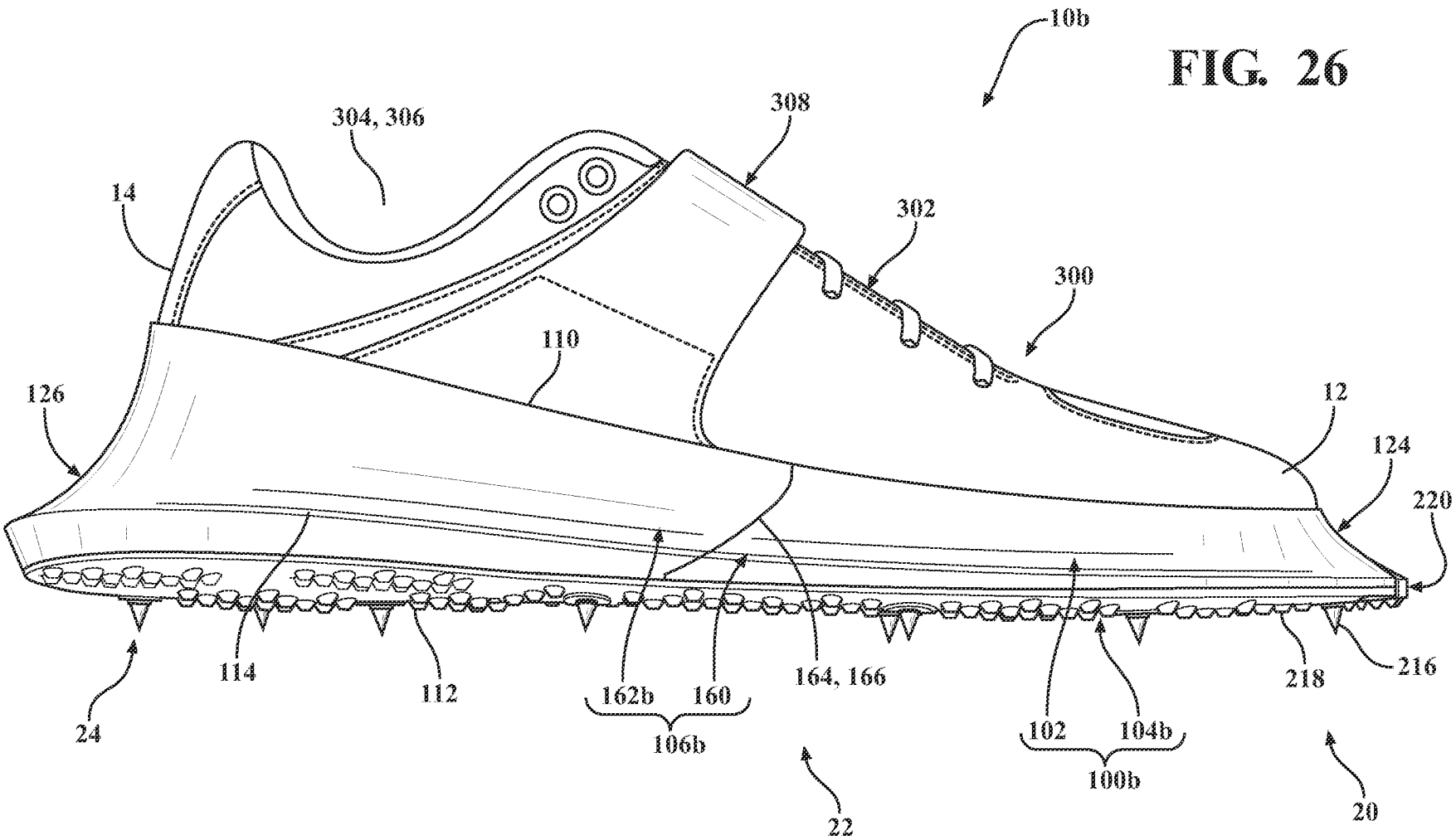
FIG. 26 is a lateral side elevation view of an article of footwear including another example of a sole structure according to principles of the present disclosure.
Figure 27:
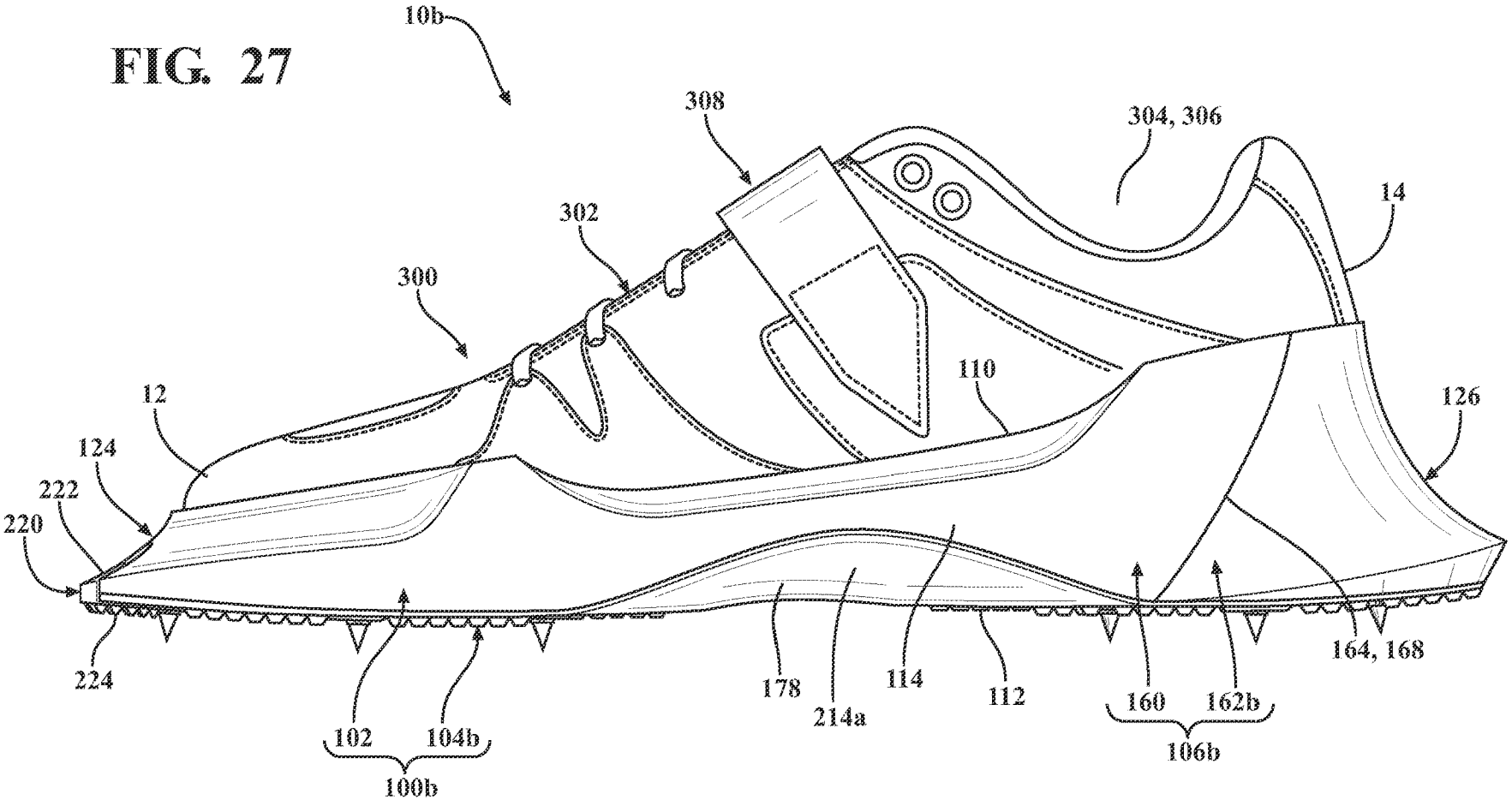
FIG. 27 is a medial side elevation view of the article of footwear of FIG. 26.
Figure 28:
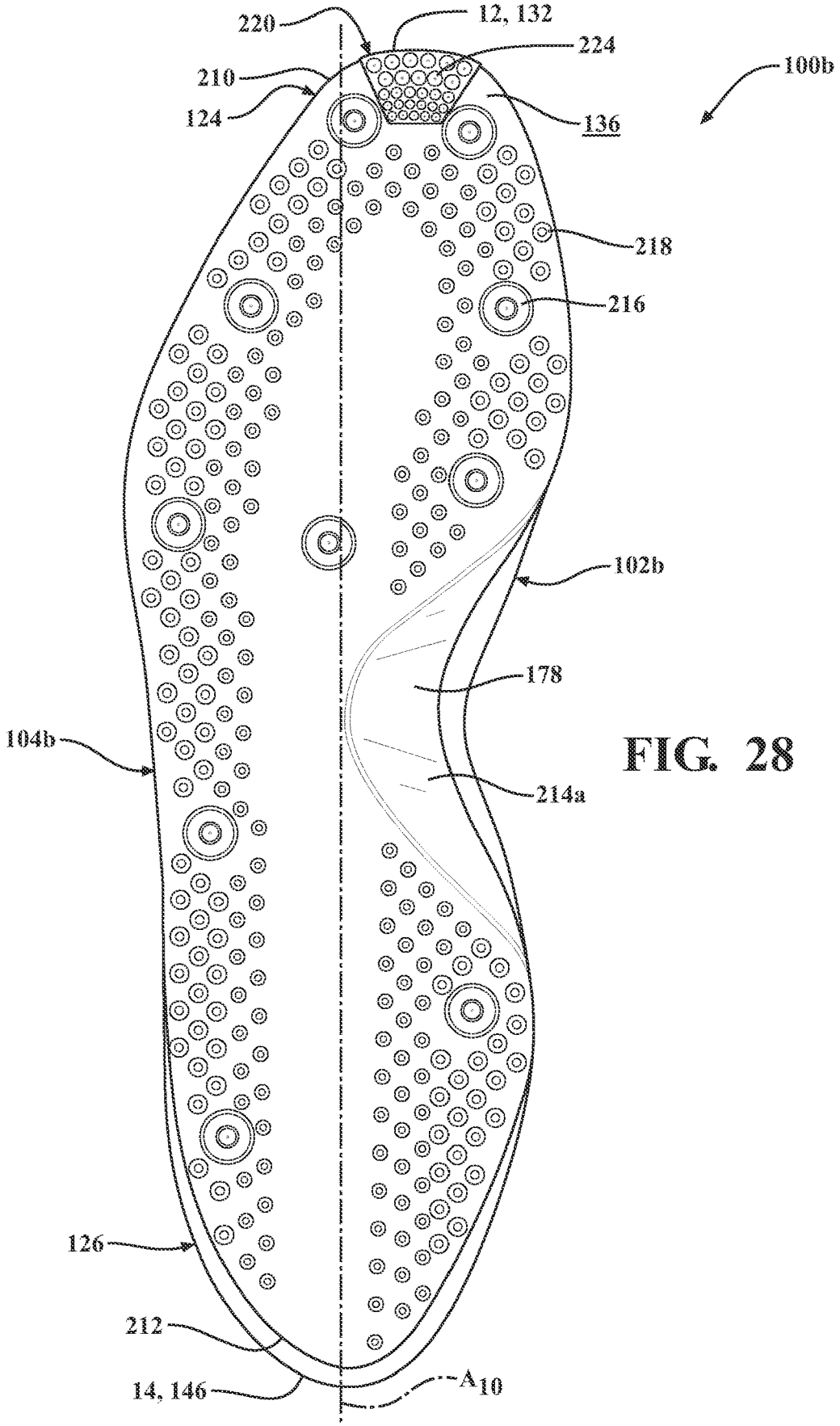
FIG. 28 is a bottom plan view of the sole structure of FIG. 26.
Figure 29:
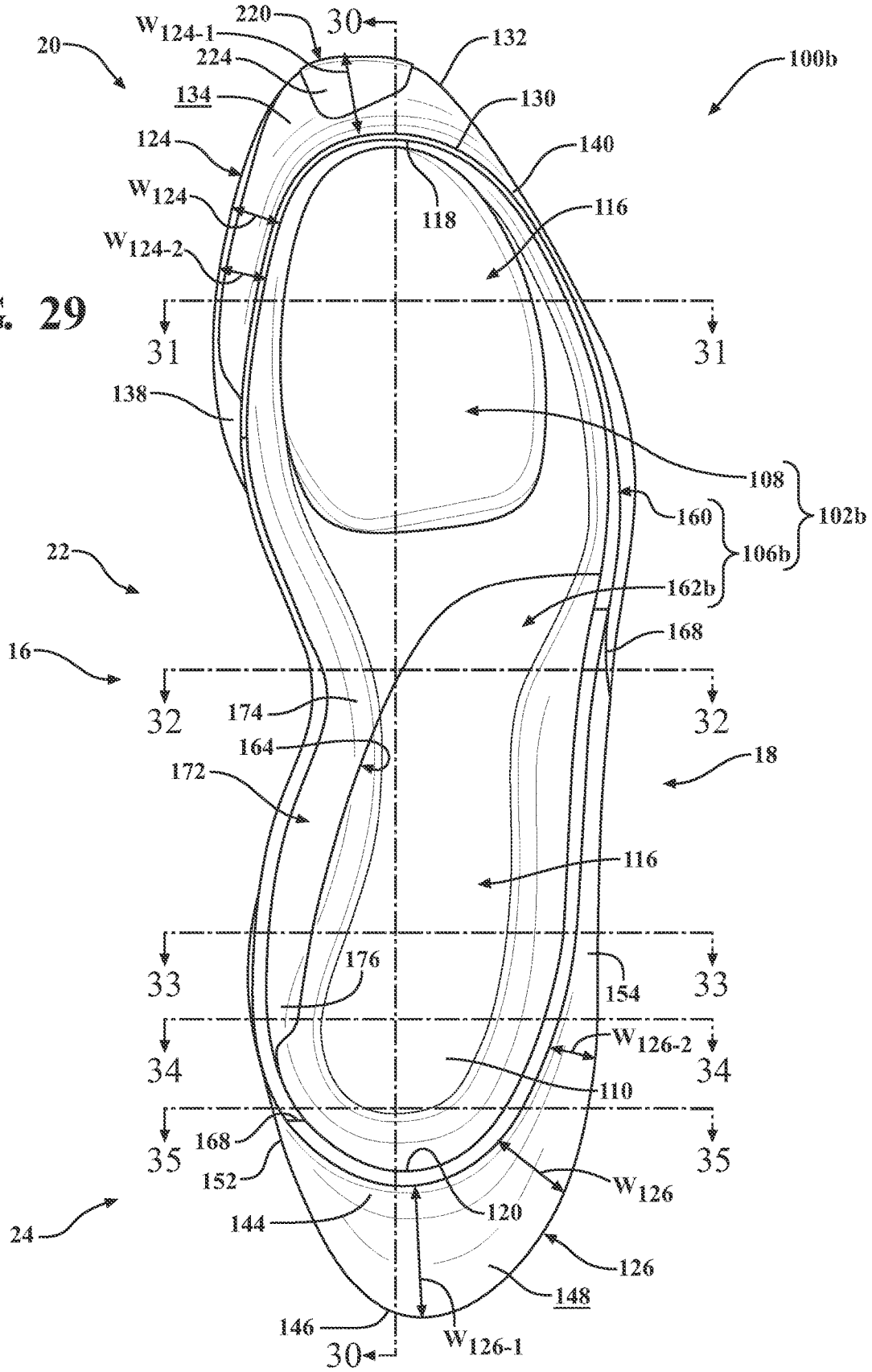
FIG. 29 is a top plan view of the sole structure of FIG. 26.
Figure 30:
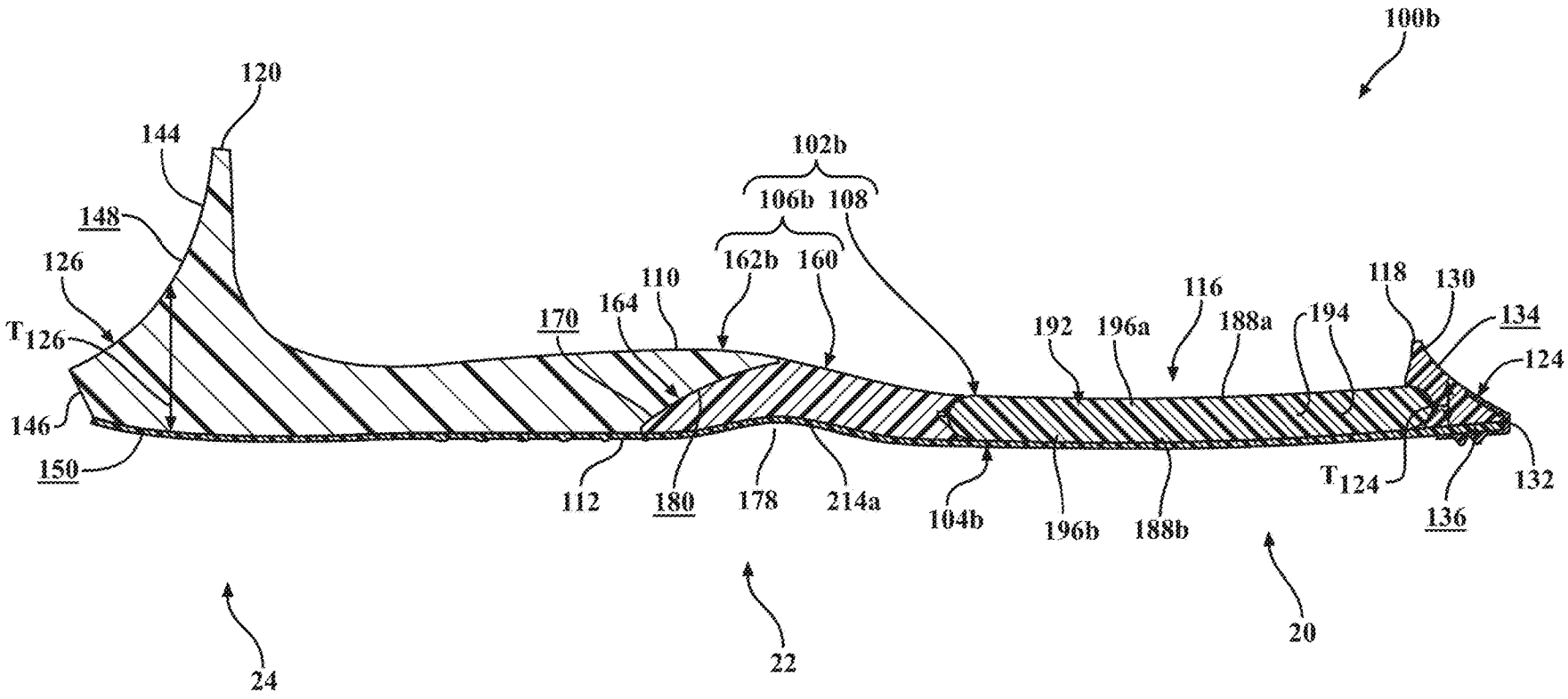
FIG. 30 is a cross-sectional view of the sole structure of FIG. 26, taken along Line 30-30 in FIG. 29.
Figure 31:
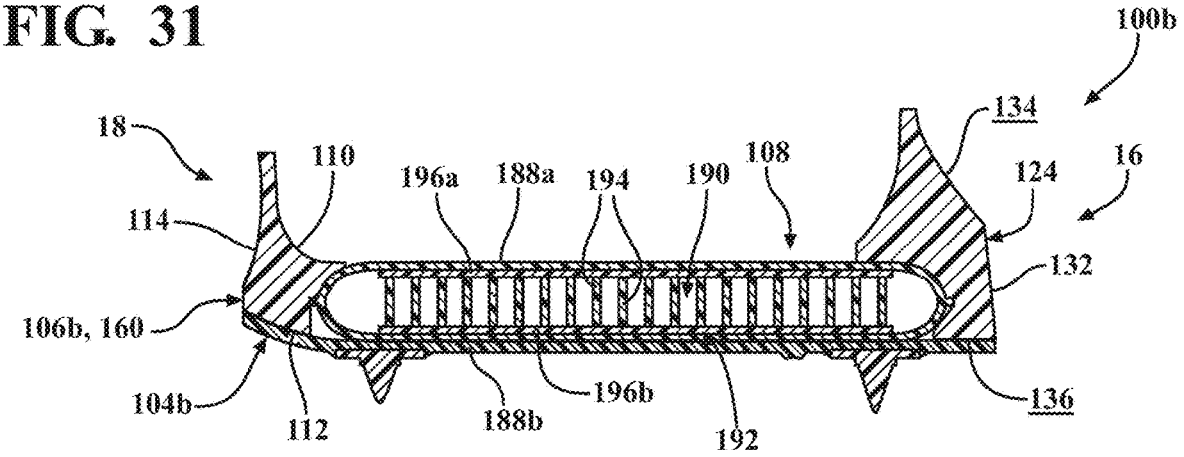
FIG. 31 is a cross-sectional view of the sole structure of FIG. 26, taken along Line 31-31 in FIG. 29.
Figure 32:
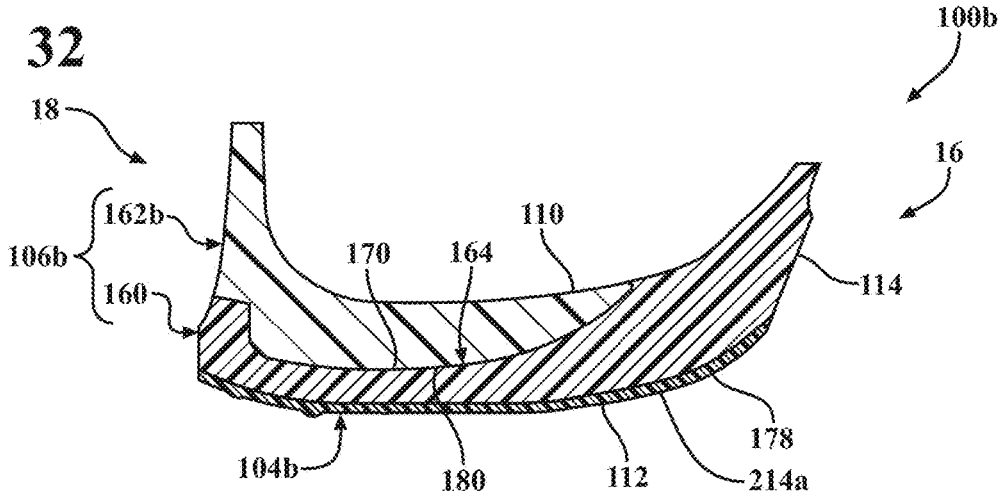
FIG. 32 is a cross-sectional view of the sole structure of FIG. 26, taken along Line 32-32 in FIG. 29.
Figure 33:
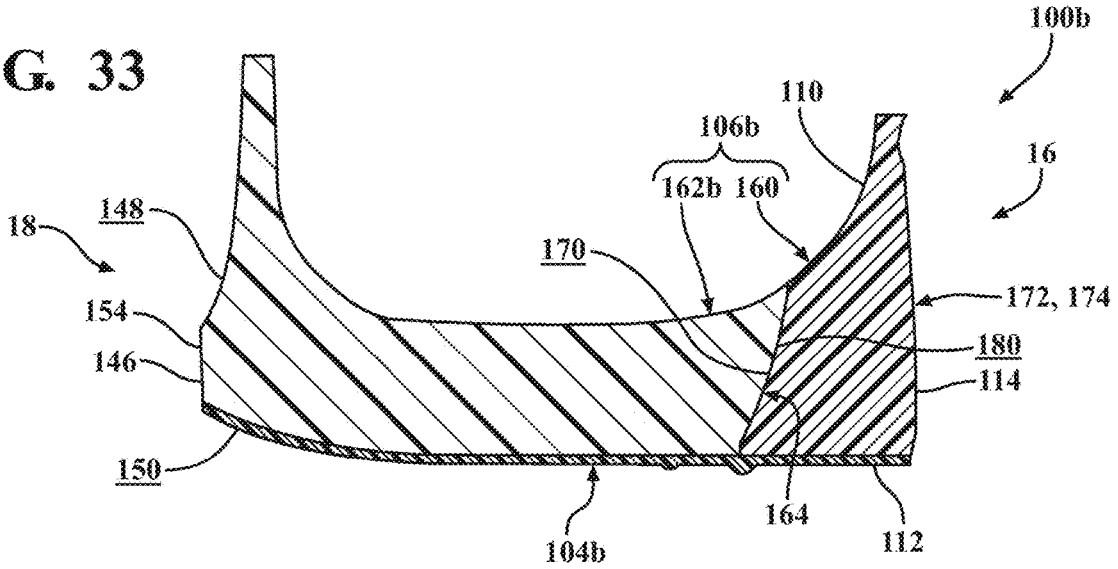
FIG. 33 is a cross-sectional view of the sole structure of FIG. 26, taken along Line 33-33 in FIG. 29.
Figure 34:
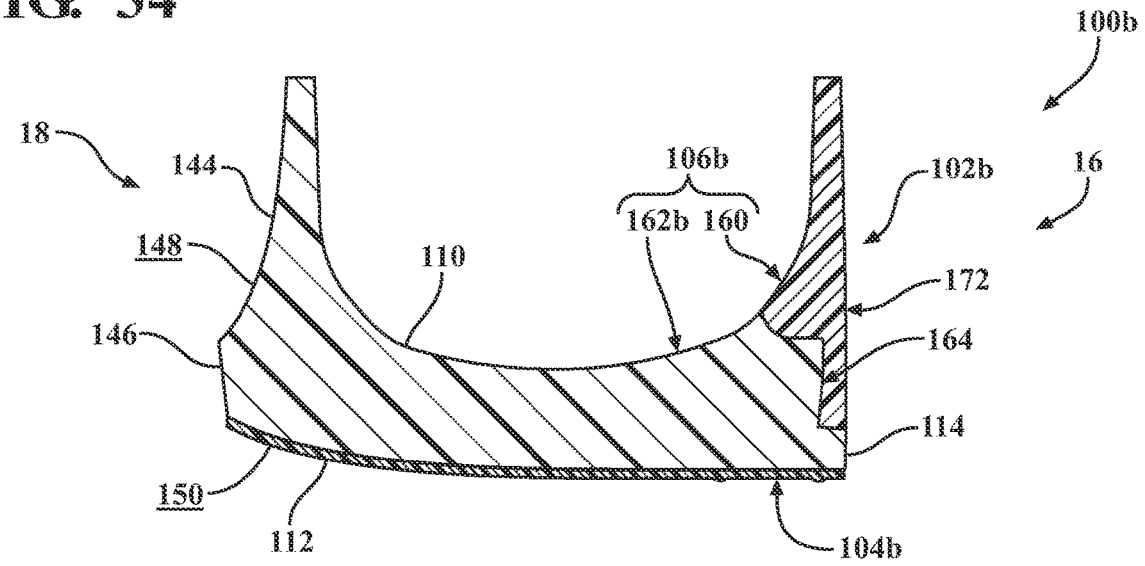
FIG. 34 is a cross-sectional view of the sole structure of FIG. 26, taken along Line 34-34 in FIG. 29.
Figure 35:
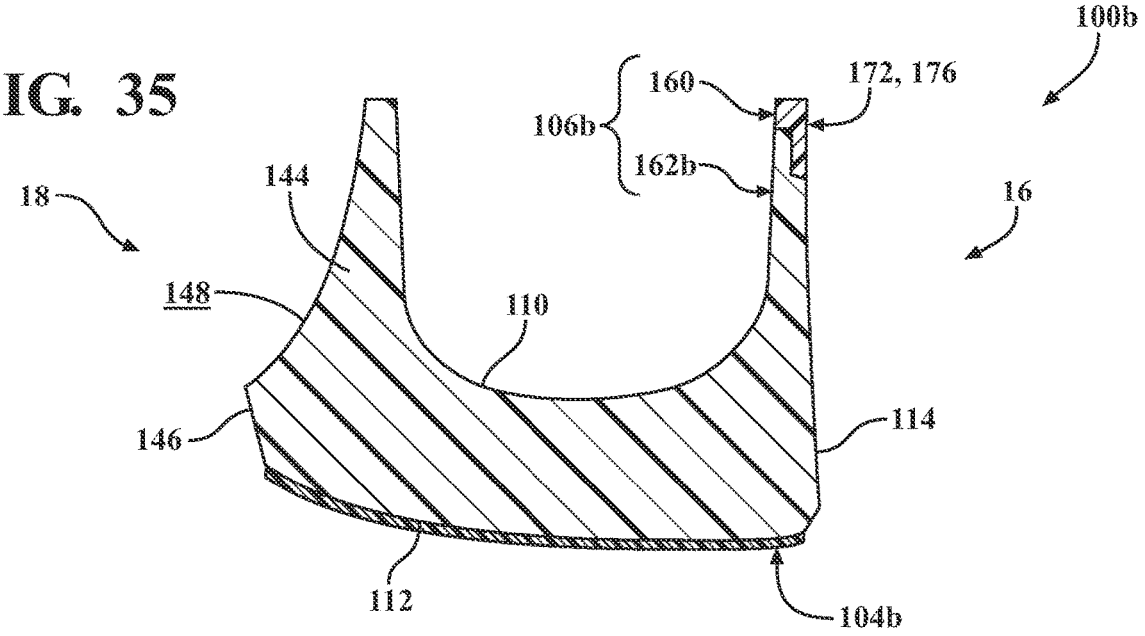
FIG. 35 is a cross-sectional view of the sole structure of FIG. 26, taken along Line 35-35 in FIG. 29.
Figure 36:
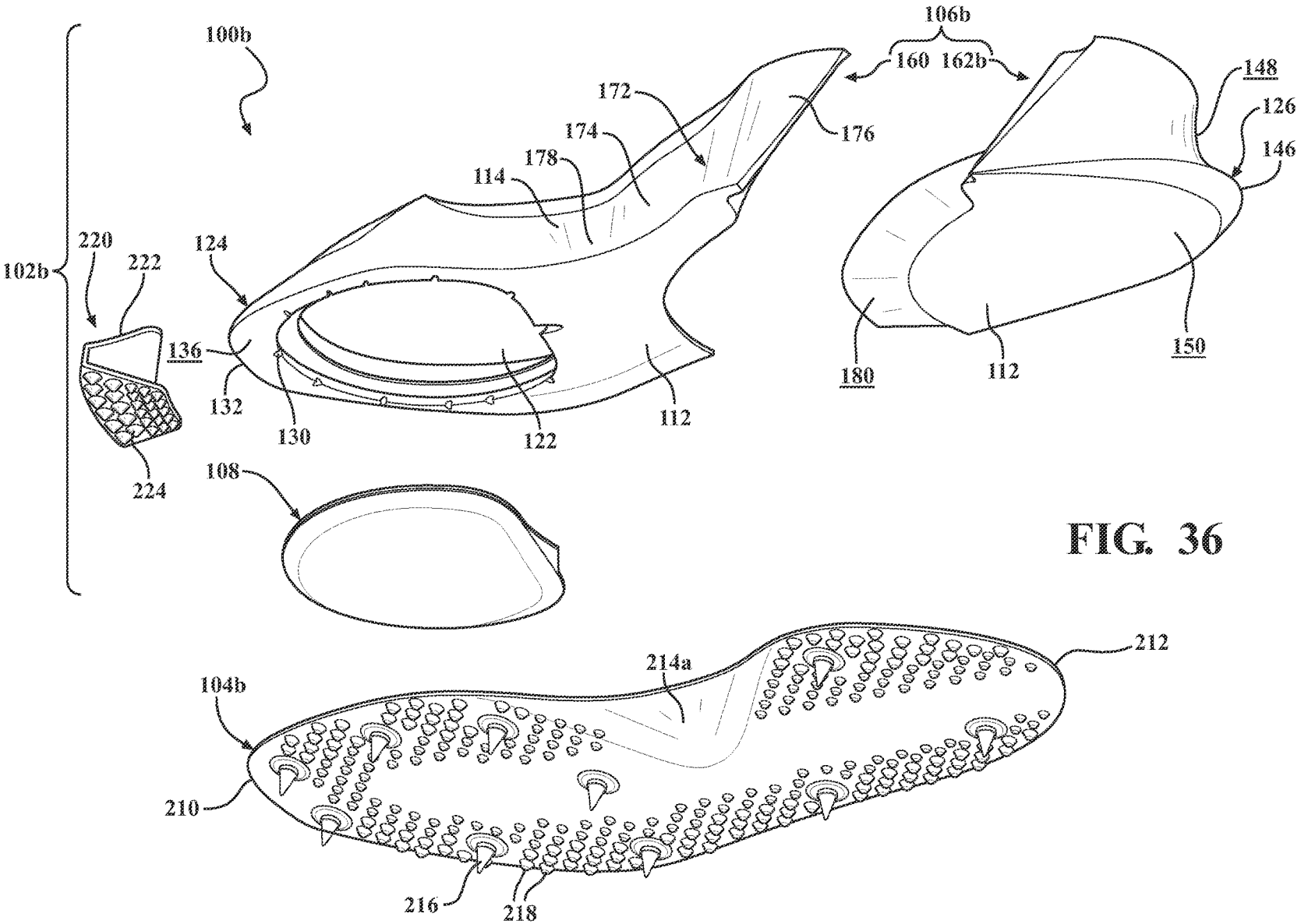
FIG. 36 is a bottom-rear exploded perspective view of the sole structure of FIG. 26.
Figure 37:
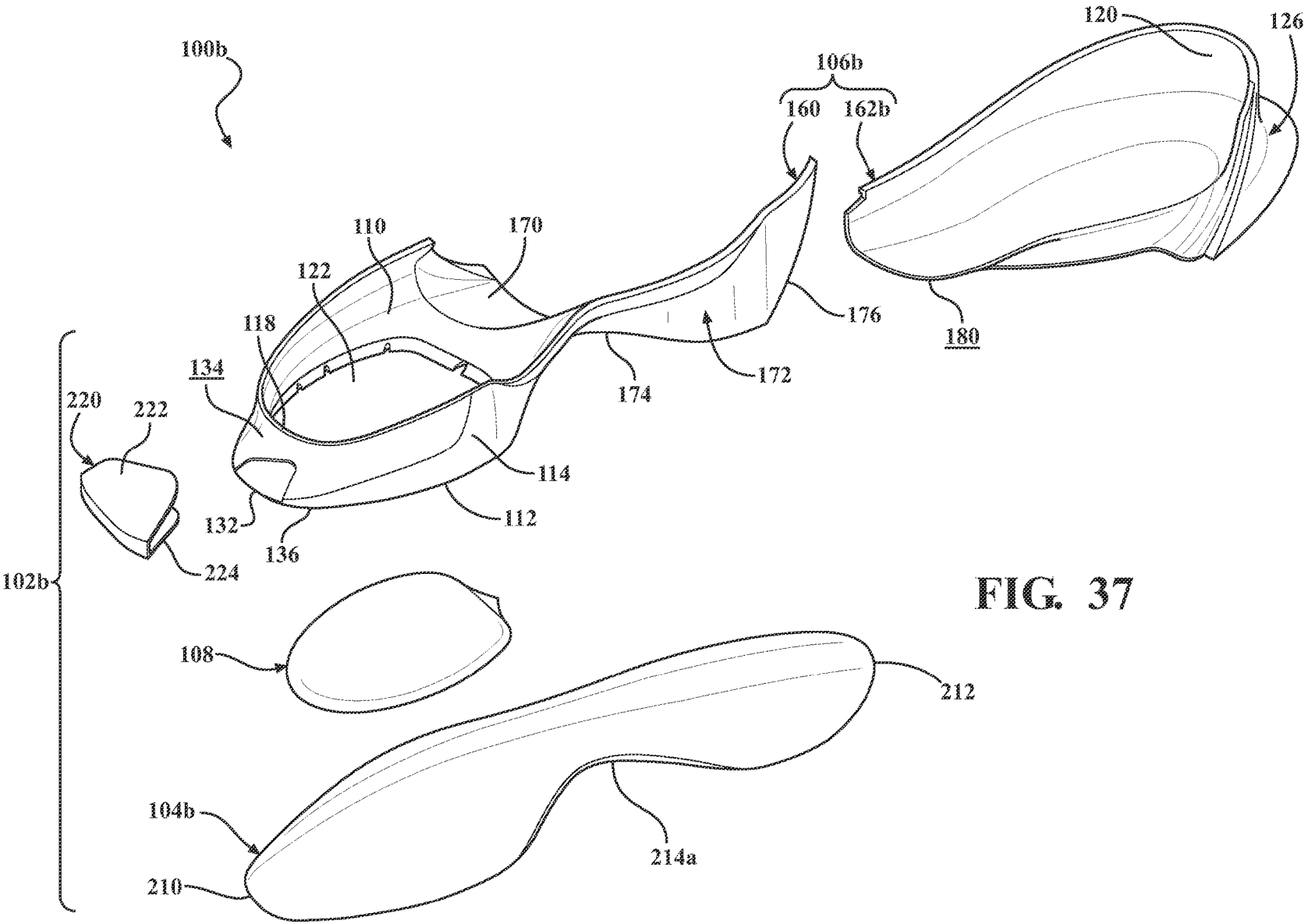
FIG. 37 is a top-front exploded perspective view of the sole structure of FIG. 26.
Figure 38:
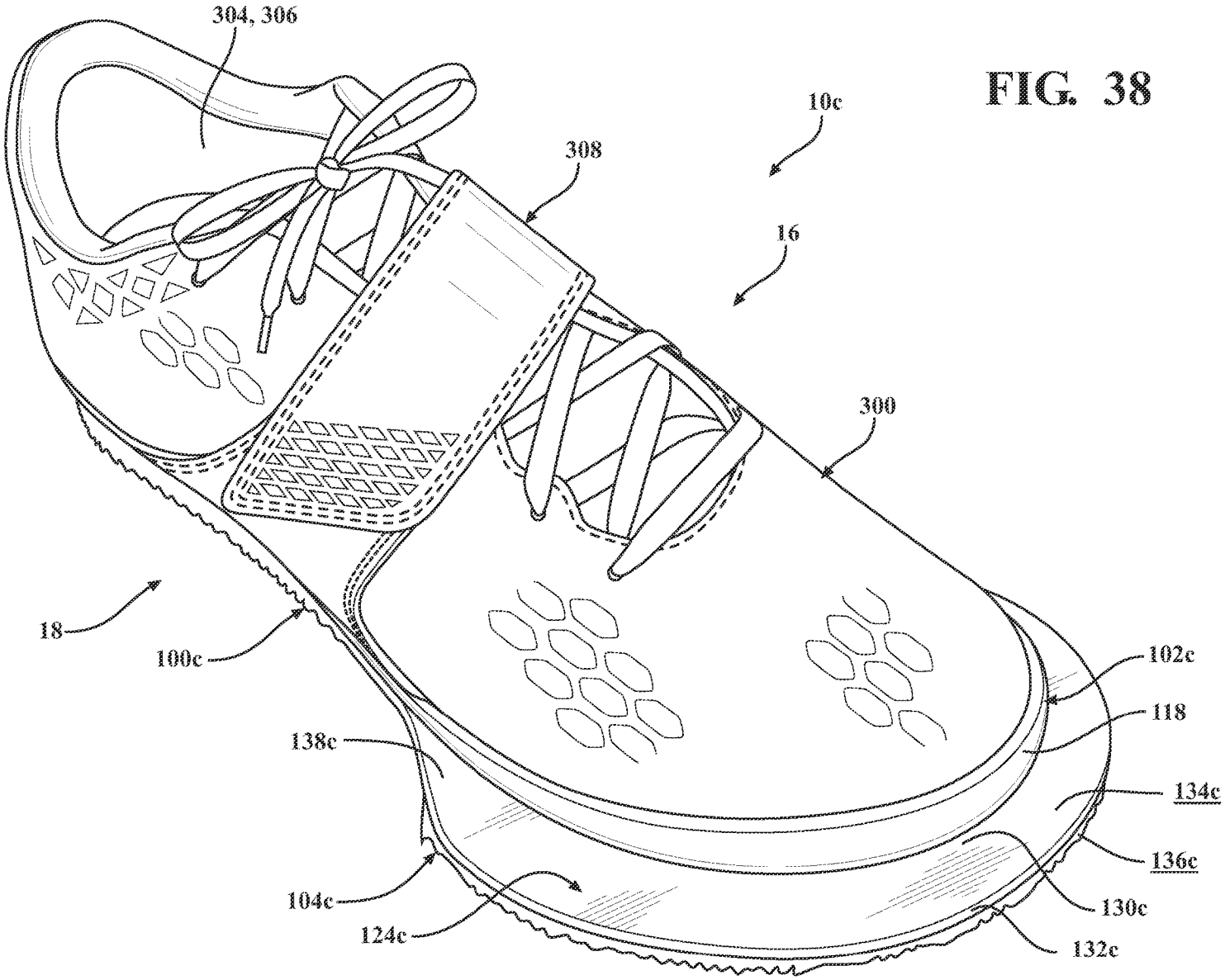
FIG. 38 is a lateral side perspective view of an article of footwear including another example of a sole structure according to principles of the present disclosure.
Figure 39:
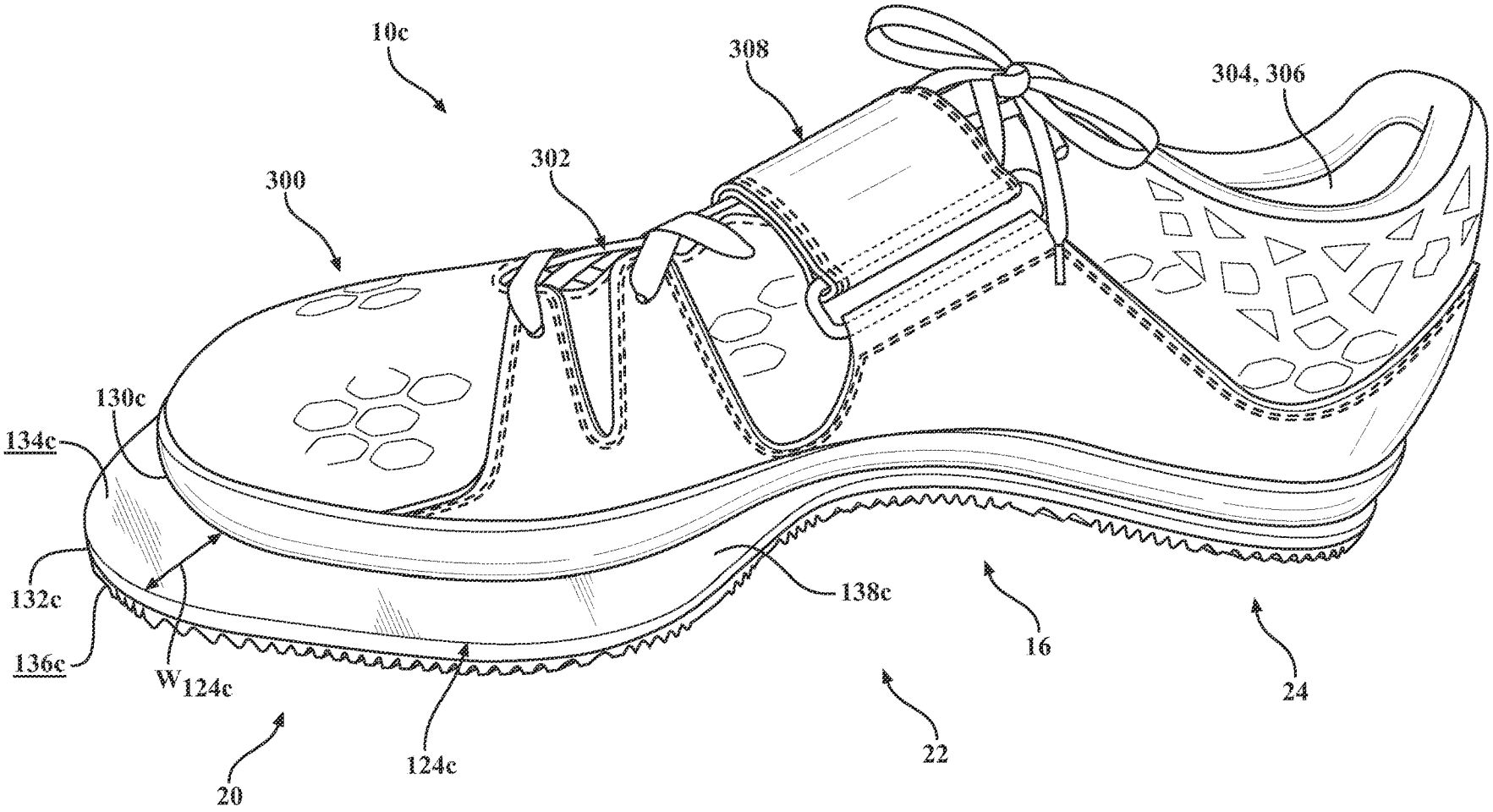
FIG. 39 is a medial side perspective view of the article of footwear of FIG. 38.
Figure 40:
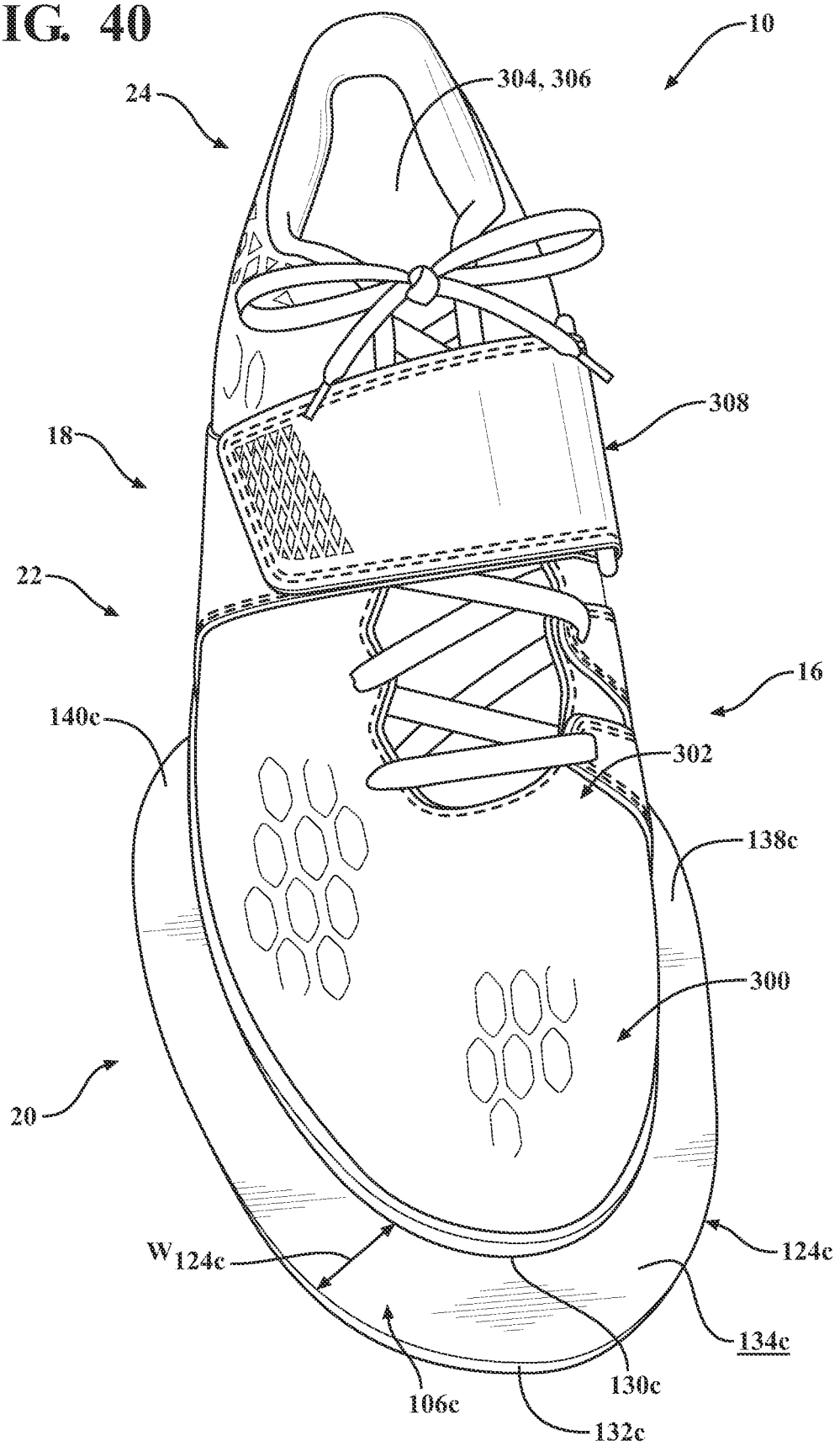
FIG. 40 is a top-front perspective view of the article of footwear of FIG. 38.
Figure 41:
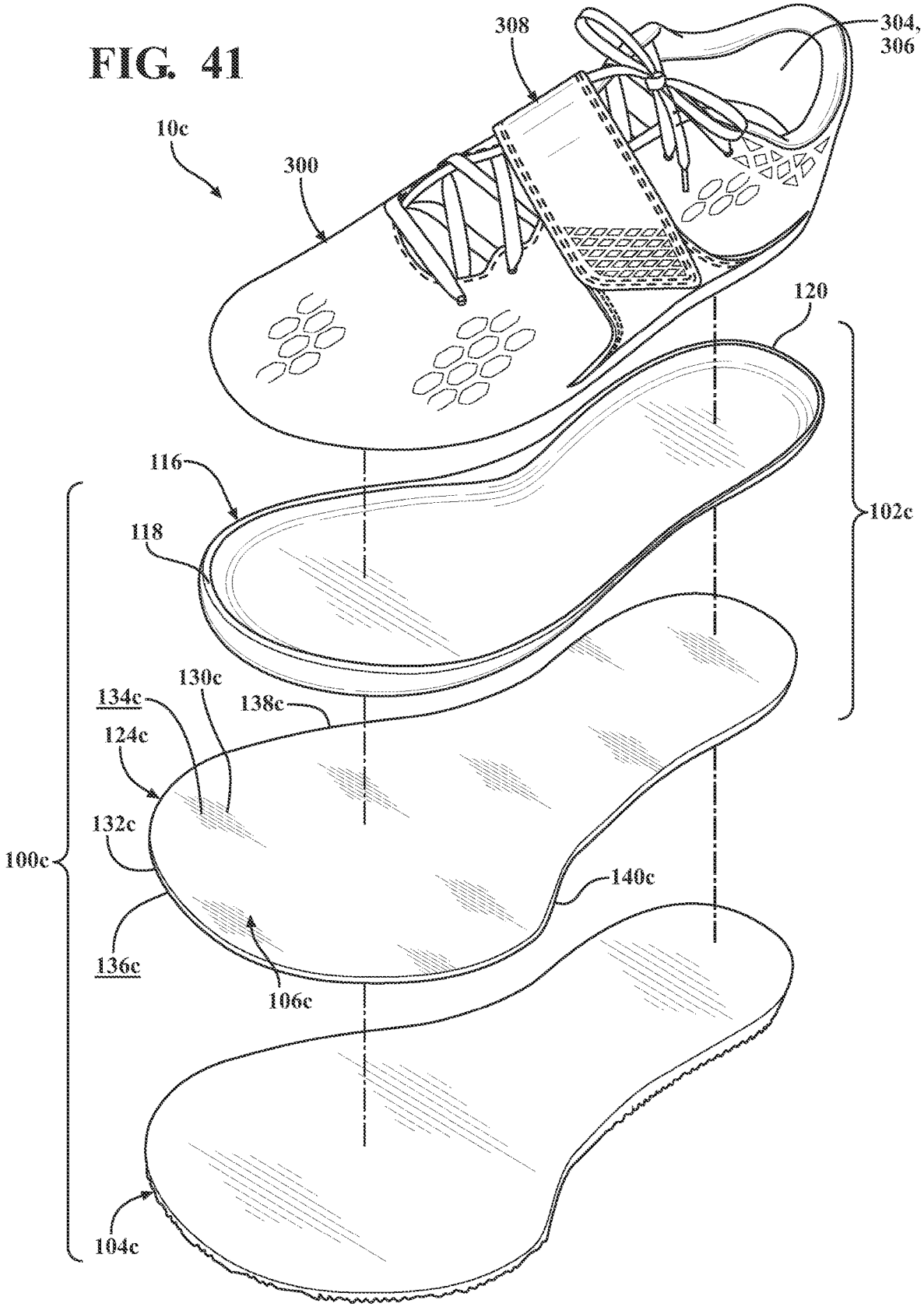
FIG. 41 is an exploded perspective view of the article of footwear of FIG. 38.

As shown in FIGS. 2, 4, and 12, the anterior cushioning member 160 may form an arch portion 178 of the cushioning element 106 in the mid-foot region 22 on the medial side 16. Thus, while the bottom side 112 of the cushioning element 106 is substantially flat, the arch portion 178 forms a concave recess along the medial side 16.

The posterior cushioning member 162 extends through the heel region 24 from a first end at the distal end 146 of the posterior flange 126 to a second end in the mid-foot region 22 defining a posterior joint face 180 of the joint 164. Here, the posterior joint face 180 is formed oriented at an oblique angle relative to the top and bottom sides 110, 112 of the cushioning element 106. In other words, the second end of the posterior cushioning member 162 tapers towards the top side 110 such that the top side 110 of the posterior cushioning member 162 extends beyond the bottom side 112 at the joint 164. The posterior joint face 180 includes a first portion configured to mate with the first portion of the anterior joint face 170 and a second portion configured to mate with the second portion of the anterior joint face 170. Thus, the second portion of the posterior joint face 180 is configured to receive the arm 172 of the anterior cushioning member 160.

Figure 6:
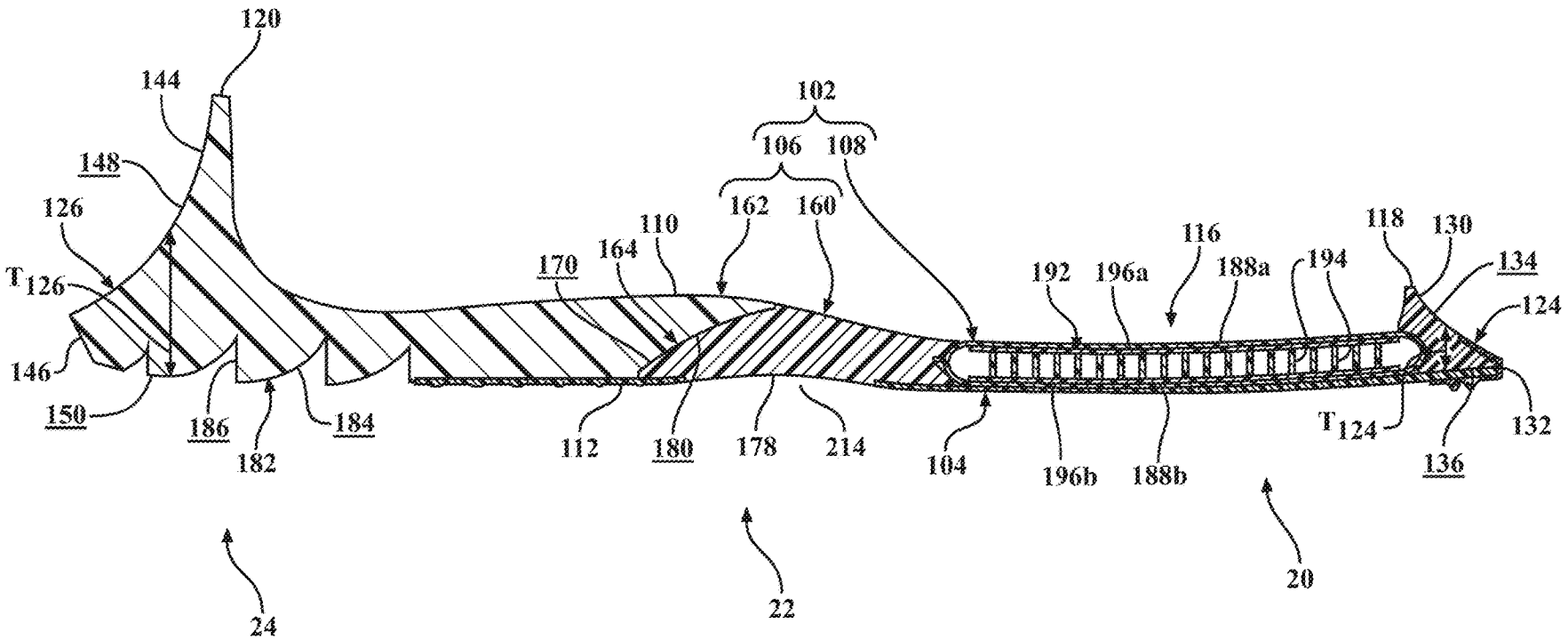
FIG. 6 is a cross-sectional view of the sole structure of FIG. 1, taken along Line 6-6 in FIG. 5.

As shown in FIGS. 4, 6, and 12, a portion of the bottom side 112 of the cushioning element 106 formed by the posterior cushioning member 162 may include a plurality of laterally-extending serrations 182 arranged in series between the joint 164 and the distal end 146 of the posterior flange 126. A cross-section (FIGS. 9-11) of each of the serrations 182 is defined by a convex anterior face 184 and a straight posterior face 186. A length of each serration 182 extends along an arcuate path having a compound curvature (e.g., S-shaped) from a first end on the medial side 16 to a second end on the lateral side 18. In the illustrated example, the lengths of the serrations 182 are generally oriented at an oblique angle relative to the longitudinal axis $A_{10}$ of the footwear 10 such that the first end of each serration 182 is closer to the posterior end 14 than the corresponding second end of the respective serration 182 on the lateral side 18. Thus, the straight posterior faces 186 of the serrations 182 face in a posterior-lateral direction and allow the posterior cushioning member 162 to articulate towards the lateral side 18 in the heel region 24.

As described above, the components 160, 162 of the cushioning element 106 are formed of a resilient polymeric material, such as foam or rubber, to impart properties of cushioning, responsiveness, and energy distribution to the foot of the wearer. In the illustrated example, the anterior cushioning member 160 includes a first foam material and the posterior cushioning member 162 includes a second foam material. The first foam material of the anterior cushioning member 160 has a higher hardness than the second foam material to provide the sole structure 100 with greater cushioning during a heel strike in the heel region 24 and greater responsiveness along the mid-foot region 22 and the forefoot region 20 through the remainder of the stance phase to push-off.

Example resilient polymeric materials for the cushioning element 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 7:
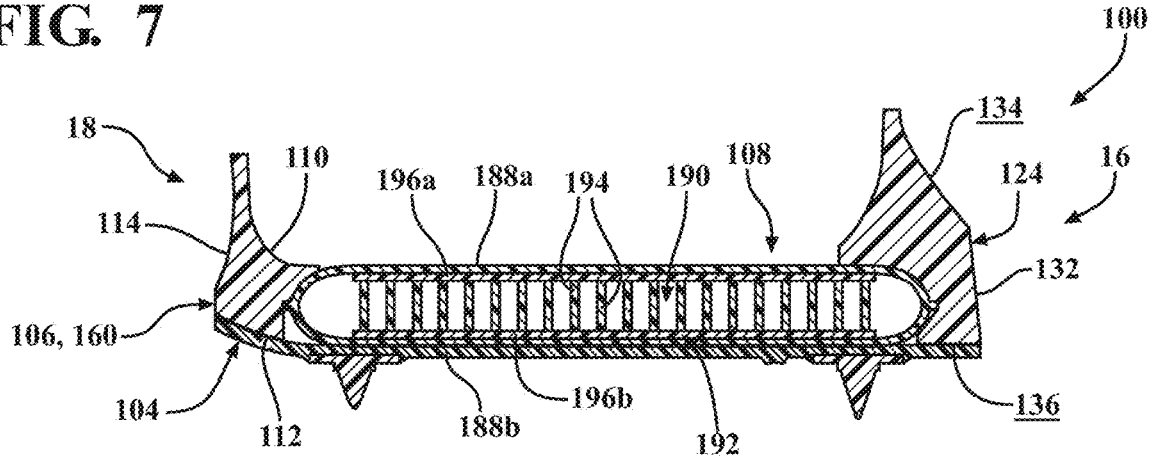
FIG. 7 is a cross-sectional view of the sole structure of FIG. 1, taken along Line 7-7 in FIG. 5.
Figure 8:
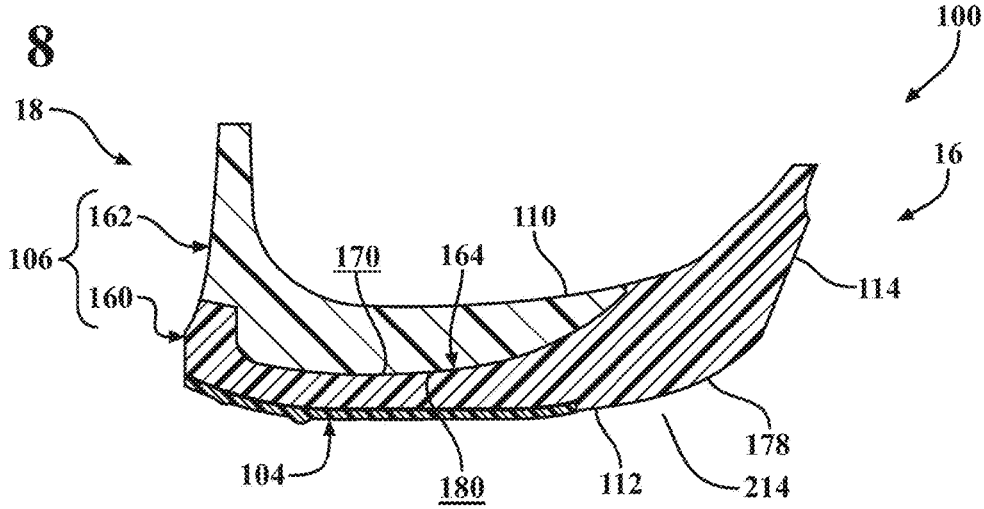
FIG. 8 is a cross-sectional view of the sole structure of FIG. 1, taken along Line 8-8 in FIG. 5.
Figure 9:
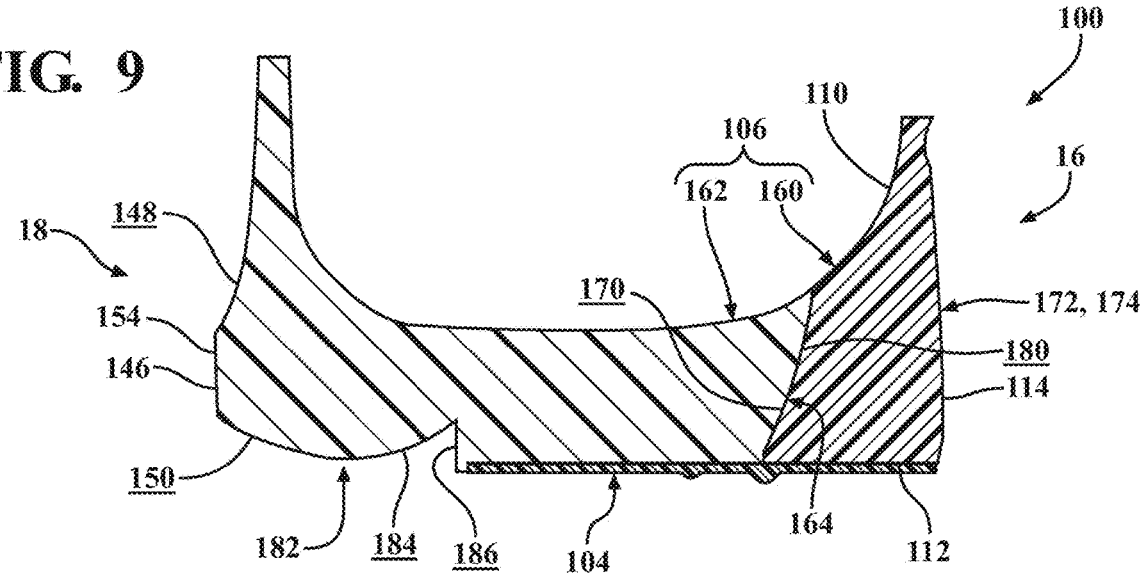
FIG. 9 is a cross-sectional view of the sole structure of FIG. 1, taken along Line 9-9 in FIG. 5.
Figure 10:
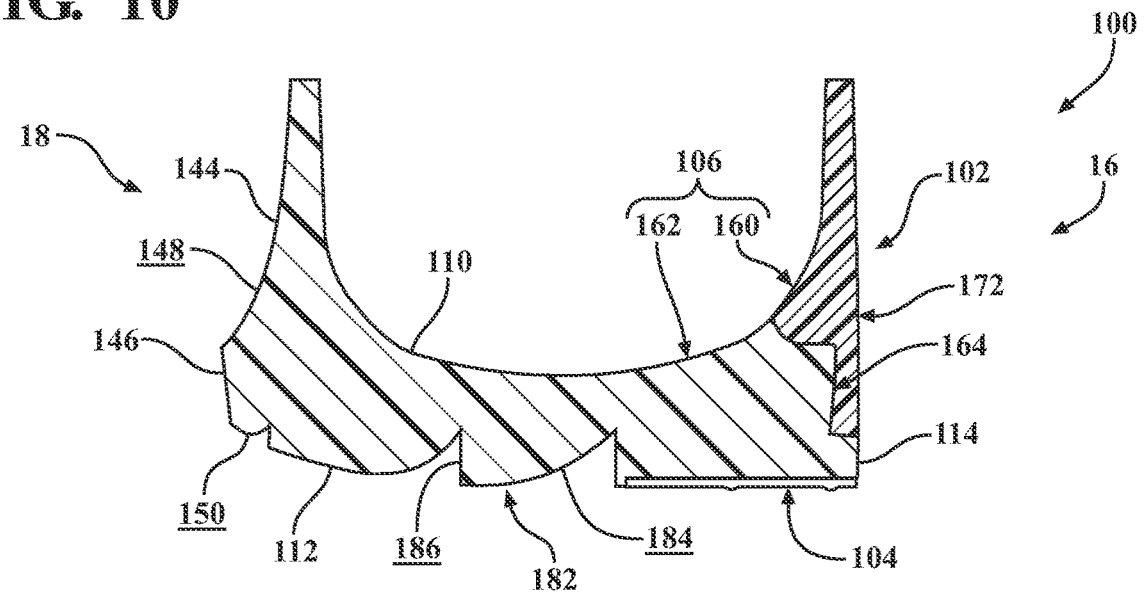
FIG. 10 is a cross-sectional view of the sole structure of FIG. 1, taken along Line 10-10 in FIG. 5.
Figure 11:
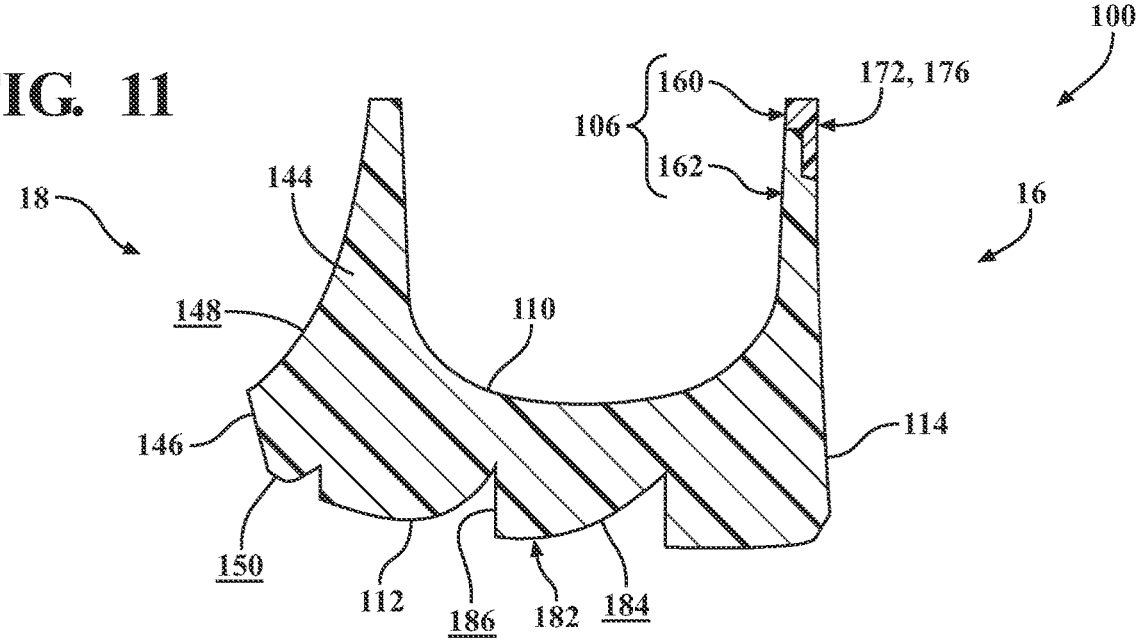
FIG. 11 is a cross-sectional view of the sole structure of FIG. 1, taken along Line 11-11 in FIG. 5.

With particular reference to FIGS. 6 and 7, the bladder 108 is received within the receptacle 122 formed in the anterior cushioning member 160. The bladder 108 includes a pair of barrier layers 188*a*, 188*b* formed and joined together along a peripheral seam to define a chamber 190 within the bladder 108. Here, an upper barrier layer 188*a* defines a top side of the bladder 108 and a lower barrier layer 188*b* defines a bottom side of the bladder 108. When the sole structure 100 is assembled, the upper barrier layer 188*a* is flush with the anterior cushioning member 160 along the top side 110 of the midsole 102 and the lower barrier layer 188*b* is flush with the anterior cushioning member 160 along the bottom side 112 of the midsole 102.

As used herein, the term "barrier layer" (e.g., barrier layers 188*a*, 188*b*) encompasses both monolayer and multilayer films. In some embodiments, one or both of the barrier layers 188*a*, 188*b* are each produced (e.g., thermoformed or blow molded) from a monolayer film (a single layer). In other embodiments, one or both of the barrier layers 188*a*, 188*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 188*a*, 188*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 188*a*, 188*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 188*a*, 188*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 188*a*, 188*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 188*a*, 188*b* may each independently include alternating sublayers of one or more TPU copolymer materials and one or more EVOH copolymer materials, where the total number of sublayers in each of the barrier layers 188*a*, 188*b* includes at least four (4) sublayers, at least ten (10) sublayers, at least twenty (20) sublayers, at least forty (40) sublayers, and/or at least sixty (60) sublayers.

The fluid-filled chamber 190 can be produced from the barrier layers 188*a*, 188*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 188*a*, 188*b* can be produced by co-extrusion followed by vacuum thermoforming to produce an inflatable chamber 190, which can optionally include one or more valves (e.g., one way valves) that allows the chamber 190 to be filled with the fluid (e.g., gas).

The chamber 190 can be provided in a fluid-filled (e.g., as provided in footwear 10) or in an unfilled state. The chamber 190 can be filled to include any suitable fluid, such as a gas or liquid. In an aspect, the gas can include air, nitrogen ($N_2$), or any other suitable gas. In other aspects, the chamber 190 can alternatively include other media, such as pellets, beads, ground recycled material, and the like (e.g., foamed beads and/or rubber beads). The fluid provided to the chamber 190 can result in the chamber 190 being pressurized. Alternatively, the fluid provided to the chamber 190 can be at atmospheric pressure such that the chamber 190 is not pressurized but, rather, simply contains a volume of fluid at atmospheric pressure.

The chamber 190 desirably has a low gas transmission rate to preserve its retained gas pressure. In some embodiments, the fluid-filled chamber 190 has a gas transmission rate for nitrogen gas that is at least about ten (10) times lower than a nitrogen gas transmission rate for a butyl rubber layer of substantially the same dimensions. In an aspect, fluid-filled chamber 190 has a nitrogen gas transmission rate of 15 cubic-centimeter/square-meter·atmosphere·day ($cm^3/m^2$·atm·day) or less for an average film thickness of 500 micrometers (based on thicknesses of the barrier layers 188*a*, 188*b*). In further aspects, the transmission rate is 10 $cm^3/m^2$·atm·day or less, 5 $cm^3/m^2$·atm·day or less, or 1 $cm^3/m^2$·atm·day or less.

The chamber 190 of the bladder 108 may receive a tensile element 192 (FIG. 7) therein. Each tensile element 192 may include a series of tensile strands 194 extending between an upper tensile sheet 196*a* and a lower tensile sheet 196*b*. The upper tensile sheet 196*a* may be attached to a first one of the barrier layers 188*a* while the lower tensile sheet 196*b* may be attached to a second one of the barrier layers 188*b*. In this manner, when the chamber 190 receives the pressurized fluid, the tensile strands 194 of the tensile element 192 are placed in tension. Because the upper tensile sheet 196*a* is attached to the upper barrier layer 188*a* and the lower tensile sheet 196*b* is attached to the lower barrier layer 188*b*, the tensile strands retain a desired shape of the bladder 108 when the pressurized fluid is injected into the chambers 190.

Optionally, the midsole 102 may include a moderator plate (not shown) disposed adjacent to the top side 110 of the midsole 102. Generally, the moderator plate is positioned adjacent to the upper barrier layer 188*a* of the bladder 108 and is configured to distribute a compression force applied by the ball portion of the foot during a jump or a push-off phase of a gait cycle. The plate may have a variable stiffness to provide a greater stiffness in the forefoot region 20 and/or the heel region 24 than in the mid-foot region 22. When included, the plate may include a full-length plate extending from the first end 118 of the footbed 116 to the second end 120 of the footbed, a partial-length plate extending through one or more of the regions 20, 22, 24, or a fragmentary plate including one or more independent plate segments each disposed in one or more of the regions 20, 22, 24.

The plate includes a material providing relatively high strength and stiffness, such as polymeric material and/or composite materials. In some examples, the plate is a composite material manufactured using fiber sheets or textiles, including pre-impregnated (i.e., "prepreg") fiber sheets or textiles. Alternatively or additionally, the plate may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other.

In some implementations, the plate includes a substantially uniform thickness. In some examples, the thickness of the plate ranges from about 0.6 millimeters (mm) to about 3.0 mm. In one example, the thickness of the plate is substantially equal to one 1.0 mm. In other implementations, the thickness of the plate is non-uniform such that the plate may have a greater thickness in one region 20, 22, 24 the sole structure 100 than the thicknesses in the other regions 20, 22, 24.

The outsole 104 is formed of a resilient polymeric material and is attached to the bottom side 112 of the cushioning element 106. In the illustrated example, the outsole 104 extends from a first end 210 at the distal end 132 of the anterior flange 124 to a second end 212 in the heel region 24 and includes a greater rigidity than the midsole 102. In this example, the second end 212 of the outsole 104 terminates adjacent to the serrations 182 and includes a corresponding compound curvature extending from the medial side 16 to the lateral side 18. Accordingly, the outsole 104 covers the bottom side 112 of the midsole 102 in the forefoot region 20 and the mid-foot region 22, while the soft foam material of the posterior cushioning member 162 is exposed in the heel region 24.

The outsole 104 is substantially flat from the first end 210 to the second end 212. In this example, the outsole 104 includes a cutout 214 corresponding to the arch 178 of the midsole 102. Thus, the outsole 104 extends around the arch 178 such that the arch 178 is exposed to the ground surface through the cutout 214. The outsole 104 includes a plurality of primary traction elements 216 and secondary traction elements 218 arranged along the length of the outsole 104. For example, the primary traction elements 216 may include a plurality of conical spikes formed of a harder material than the outsole 104, while the secondary traction elements 218 include a plurality of nubs or protrusions integrally formed of the same material as the outsole 104 and having a height that is less than a height of the primary traction elements 216.

The cutout 214 in the arch 178 provides the outsole 104 with an area of decreased width in a direction extending across a width of the outsole 104. As such, the cutout 214 locally weakens the outsole 104 to permit the outsole 104 and, thus, the sole structure 100, to bend and twist a desired amount at the arch 178.

In the illustrated example, the sole structure 100 further includes a toe clip 220 extending over the anterior end 12 of the footwear 10. The toe clip 220 includes a lower portion 222 extending along the outsole 104 and an upper portion 224 extending along the toe of the upper 300. The toe clip 220 may be formed of a material having a greater hardness than the midsole 102, the outsole 104, and/or the upper 300 to provide rigidity and abrasion resistance along the anterior end 12 of the footwear 10.

The upper 300 forms an enclosure having plurality of components that cooperate to define a bootie 302 including an interior void 304 and an ankle opening 306, which cooperate to receive and secure a foot for support on the sole structure 100. In the illustrated example, the upper 300 includes an adjustable strap 308 extending over an instep region of the bootie 302 adjacent to the ankle opening 306. The strap 308 provides supplementary tightening and security along the instep of the bootie 302 to secure the foot of the wearer onto the footbed 116 of the sole structure 100.

In some examples, the bootie 302 of the upper 300 may be formed as a monolithic knit structure configured to provide a soft and pliable enclosure for securing the foot to the sole structure 100. By using a knit bootie 302, the upper 300 can be formed without conventional sockliners and strobels. This construction provides a more responsive, direct interface between the footwear and the foot and also reduces the overall height of the footwear to enhance stability. In other examples, the upper 300 may be formed from one or more materials that are stitched or adhesively bonded together to define the interior void 304. Suitable materials of the upper 300 may include, but are not limited to, textiles, foam, leather, and synthetic leather.

With particular reference to FIGS. 14-25, an article of footwear 10*a* is provided and includes a sole structure 100*a* and the upper 300 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The sole structure 100*a* shown in FIGS. 14-25 is substantially similar to the sole structure shown in FIGS. 1-13. However, the sole structure 100*a* includes an outsole 104*a* including an arch portion 214*a* corresponding to the arch 178 of the midsole 102. Thus, where the outsole 104 of FIGS. 1-13 includes the cutout 214 configured to expose the arch 178, the outsole 104*a* of FIGS. 14-25 includes the arch portion 214*a* covering the arch 178. The harder material of the outsole 104*a* provides additional support and responsiveness through the arch 178 of the midsole 102 and resists bending and twisting to a greater extent than the outsole 104 of FIGS. 1-13.

With particular reference to FIGS. 26-37, an article of footwear 10*b* is provided and includes a sole structure 100*b* and the upper 300 attached to the sole structure 100*b*. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

The sole structure 100*b* shown in FIGS. 26-37 is substantially similar to the sole structure shown in FIGS. 14-25. However, in addition to including the arch portion 214*a*, the outsole 104*b* extends a full length of the midsole 102*b* from the distal end 132 of the anterior flange 124 to the distal end 146 of the posterior flange 126. When the outsole 104*b* is configured as a full-length outsole 104*b*, the midsole 102*b* may be formed without the serrations 182 in the heel region 24. Thus, the bottom side 112 of the cushioning element 106*b* at the posterior cushioning member 162*b* is substantially flat and provides a continuous interface for attaching the outsole 104*b* to the midsole 102*b*.

With particular reference to FIGS. 38-41, an article of footwear 10*c* is provided and includes a sole structure 100*c* and an upper 300 attached to the sole structure 100*c*. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

In the example of FIGS. 38-41, the midsole 102*c* includes a resilient cushioning element 106*c* attached to the bottom of the upper 300. In this example, the cushioning element 106*c* includes an anterior flange 124*c* projecting outwardly from the upper 300 in the forefoot region 20. A width $W_{124c}$ of the anterior flange 124*c* extends from a proximal end 130*c* at the upper 300 to a distal end 132*c* facing away from the upper 300. The anterior flange 124*c* has a substantially constant thickness defined by an upper surface 134*c* and a lower surface 136*c*. Thus, unlike the anterior flange 124 discussed above including the tapered thickness $T_{124}$, the anterior flange 124*c* of the present example is substantially flat. Here, the anterior flange 124*c* extends continuously around the forefoot region 20 of the upper 300 from a medial end 138*c* on the medial side 16 adjacent to the mid-foot region 22 to a lateral end 140*c* on the lateral side 18 adjacent to the mid-foot region 24. An outsole 104*c* is attached along the bottom side 112 of the cushioning element 106*c*.

The following Clauses provide an exemplary configuration for a sole structure for an article of footwear and an article of footwear described above.

Clause 1. A sole structure for an article of footwear, the sole structure comprising a midsole including a footbed extending from a first end to a second end disposed at an opposite end of the midsole than the first end, a first flange extending in a first direction from the first end of the footbed to a first distal end and a second flange extending in a second direction from the second end of the footbed to a second distal end, and an outsole disposed on an opposite side of the midsole than the footbed and extending from the first distal end through a mid-foot region, the outsole including a greater rigidity than the midsole.

Clause 2. The sole structure of Clause 1, wherein a thickness of the first flange tapers along a direction from the footbed to the first distal end.

Clause 3. The sole structure of any of the preceding Clauses, wherein the first flange includes a concave upper surface.

Clause 4. The sole structure of Clause 3, wherein the second flange incudes a concave upper surface.

Clause 5. The sole structure of any of the preceding Clauses, wherein the midsole includes an anterior cushioning member formed of a first material and a posterior cushioning member formed of a second material, the anterior cushioning member including a greater hardness than the posterior cushioning member.

Clause 6. The sole structure of Clause 5, wherein the anterior cushioning member includes the first flange and the posterior cushioning member includes the second flange.

Clause 7. The sole structure of any of the preceding Clauses, wherein the first flange extends from an anterior end of the sole structure and along a medial side of the sole structure.

Clause 8. The sole structure of Clause 7, wherein the second flange extends from a posterior end of the sole structure and along a lateral side of the sole structure.

Clause 9. The sole structure of any of the preceding Clauses, wherein the midsole includes a bladder disposed in a forefoot region.

Clause 10. The sole structure of Clause 9, further comprising a plate disposed adjacent to the bladder.

Clause 11. A sole structure for an article of footwear, the sole structure comprising a cushioning element including a footbed extending from a first end to a second end disposed at an opposite end of the cushioning element than the first end, the cushioning element including a first flange projecting outwardly from the footbed at the first end and along a medial side and a second flange projecting outwardly from the footbed at the second end and along a lateral side, and an outsole disposed on an opposite side of the cushioning element than the footbed and extending from the first end through a mid-foot region, the outsole including a greater rigidity than the cushioning element.

Clause 12. The sole structure of Clause 11, wherein a thickness of the first flange tapers along a direction from the footbed to a first distal end.

Clause 13. The sole structure of any of the preceding Clauses, wherein the first flange includes a concave upper surface.

Clause 14. The sole structure of any of the preceding Clauses, wherein the second flange incudes a concave upper surface.

Clause 15. The sole structure of any of the preceding Clauses, wherein the cushioning element includes an anterior cushioning member formed of a first material and a posterior cushioning member formed of a second material, the anterior cushioning member including a greater hardness than the posterior cushioning member.

Clause 16. The sole structure of Clause 15, wherein the anterior cushioning member includes the first flange and the posterior cushioning member includes the second flange.

Clause 17. The sole structure of Clause 15, wherein the anterior cushioning member defines a medial side of the cushioning element in a mid-foot region.

Clause 18. The sole structure of Clause 17, wherein the posterior cushioning member defines a lateral side of the cushioning element in the mid-foot region.

Clause 19. The sole structure of any of the preceding Clauses, further comprising a bladder disposed in a forefoot region of the cushioning element.

Clause 20. The sole structure of Clause 19, further comprising a plate disposed adjacent to the bladder.

Clause 21. A sole structure for an article of footwear, the sole structure comprising, a cushioning element including a first cushion disposed in a forefoot region of the sole structure and a second cushion disposed in a heel region of the sole structure, the second cushion being softer than the first cushion, and an outsole extending over a portion of at least one of the first cushion and the second cushion and including a greater rigidity than the first cushion and the second cushion.

Clause 22. The sole structure of Clause 21, wherein the first cushion overlaps the second cushion in at least one of a forefoot region and a mid-foot region of the sole structure.

Clause 23. The sole structure of any of the preceding Clauses, further comprising a first flange projecting from an anterior end of the sole structure.

Clause 24. The sole structure of Clause 23, wherein the first flange extends along a medial side of the sole structure.

Clause 25. The sole structure of any of the preceding Clauses, further comprising a second flange projecting from a posterior end of the sole structure.

Clause 26. The sole structure of Clause 25, wherein the second flange extends along a lateral side of the sole structure.

Clause 27. The sole structure of any of the preceding Clauses, further comprising a fluid-filled chamber.

Clause 28. The sole structure of Clause 27, wherein the fluid-filled chamber is received within a cavity defined by the first cushion.

Clause 29. The sole structure of Clause 27, wherein the fluid-filled chamber is pressurized.

Clause 30. The sole structure of any of the preceding Clauses, wherein the outsole includes at least one traction element.

Clause 31. The sole structure of Clause 30, wherein the at least one traction element is formed from the same material as the outsole.

Clause 32. The sole structure of Clause 30, wherein the at least one traction element is formed from a different material than the outsole.

Clause 33. An article of footwear incorporating the sole structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a cushioning element including a footbed extending from a first end to a second end, the second end disposed at an opposite end of the cushioning element than the first end, the cushioning element including a first flange comprising a first inner surface facing the second end and a first concave outer surface opposite the first inner surface, the first inner surface and the first concave outer surface each projecting outwardly from the footbed at the first end and along a medial side of the sole structure and a second flange comprising a second inner surface facing the first end and a second concave outer surface opposite the second inner surface, the second inner surface and the second concave outer surface each projecting outwardly from the footbed at the second end and along a lateral side of the sole structure; and an outsole disposed on an opposite side of the cushioning element from the footbed and extending from the first end through a mid-foot region of the sole structure, the outsole including a greater rigidity than the cushioning element.

2. The sole structure of claim 1, wherein a thickness of the first flange tapers along a direction from the footbed to a first distal end of the first flange.

3. The sole structure of claim 1, wherein the cushioning element includes an anterior cushioning member formed of a first material and a posterior cushioning member formed of a second material, the anterior cushioning member including a greater hardness than the posterior cushioning member.

4. The sole structure of claim 3, wherein the anterior cushioning member includes the first flange and the posterior cushioning member includes the second flange.

5. The sole structure of claim 3, wherein the anterior cushioning member defines a medial side of the cushioning element in the mid-foot region.

6. The sole structure of claim 5, wherein the posterior cushioning member defines a lateral side of the cushioning element in the mid-foot region.

7. The sole structure of claim 1, further comprising a bladder disposed in a forefoot region of the cushioning element.

* * * * *